US006295192B1

(12) United States Patent
Kishida et al.

(10) Patent No.: US 6,295,192 B1
(45) **Date of Patent: *Sep. 25, 2001**

(54) SWITCHGEAR

(75) Inventors: Yukimori Kishida; Kenichi Koyama; Hiroyuki Sasao; Kazuhiko Nishimiya; Yuichi Yamaji; Toshimasa Maruyama, all of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/414,504

(22) Filed: Oct. 8, 1999

Related U.S. Application Data

(62) Division of application No. 08/833,059, filed on Apr. 3, 1997, now Pat. No. 6,046,423.

(30) Foreign Application Priority Data

Apr. 3, 1996 (JP) ..... 8-236113
Sep. 6, 1996 (JP) ..... 8-081624

(51) Int. Cl.[7] ..... H01H 3/00
(52) U.S. Cl. ..... 361/160; 361/154
(58) Field of Search ..... 361/152, 153–156, 361/160

(56) References Cited

U.S. PATENT DOCUMENTS

| | | | | |
|---|---|---|---|---|
| 2,843,698 | | 7/1958 | Knauth . | |
| 3,268,687 | | 8/1966 | Waghorne et al. . | |
| 3,378,727 | | 4/1968 | Kesselring . | |
| 3,387,188 | * | 6/1968 | Euler . | |
| 3,521,080 | * | 7/1970 | Hionis et al. . | |
| 3,624,569 | | 11/1971 | Shaffer . | |
| 4,086,645 | * | 4/1978 | Gorman et al. | 361/155 |
| 4,128,856 | * | 12/1978 | Macleod | 361/156 |
| 4,223,365 | * | 9/1980 | Moran | 361/96 |
| 4,274,121 | * | 6/1981 | Howell | 361/156 |
| 4,544,986 | | 10/1985 | Büechl . | |
| 4,562,506 | * | 12/1985 | Moran | 361/71 |
| 4,645,882 | * | 2/1987 | Nakayama et al. | 361/156 |
| 4,675,776 | * | 6/1987 | Howell | 361/92 |
| 4,718,454 | * | 1/1988 | Appleby | 361/156 |
| 4,777,556 | * | 10/1988 | Imran | 361/155 |
| 4,860,157 | * | 8/1989 | Russell | 361/156 |
| 4,879,878 | * | 11/1989 | Polkinghorne | 361/156 |
| 5,015,979 | | 5/1991 | Nakanishi et al. . | |
| 5,347,421 | * | 9/1994 | Alexanian | 361/156 |
| 5,558,054 | | 9/1996 | Ariga et al. . | |
| 5,592,905 | | 1/1997 | Born . | |
| 5,765,513 | | 6/1998 | Diehl et al. . | |
| 6,046,423 | * | 4/2000 | Kishida et al. | 218/154 |

FOREIGN PATENT DOCUMENTS

| | | |
|---|---|---|
| 19 00 645 | 4/1977 | (DE) . |
| 3841592 | 6/1989 | (DE) . |
| 0 025 918 | 5/1983 | (EP) . |

OTHER PUBLICATIONS

T/23 036 (51) H 01 33/35 (71) Hungarian Abstract, Jul. 28, 1982.

* cited by examiner

*Primary Examiner*—Fritz Fleming
(74) *Attorney, Agent, or Firm*—Sughrue, Mion, Zinn, Macpeak & Seas, PLLC

(57) ABSTRACT

In a switchgear, by using a spring with a varying spring constant from closing to electrode opening as a loading spring, spring load in the opened electrode state is made smaller than a spring load in the closed electrode state to decrease the energy required from electrode closing up to electrode opening. Moreover, by using a spring in which a load in the opposite direction to a load in the closed electrode state works in the opened electrode state, the opened electrode state can be held securely.

14 Claims, 27 Drawing Sheets

LOAD CHARACTERISTICS OF SPRING

LOAD CHARACTERISTICS OF SPRING

SWITCHGEAR

This is a divisional of application Ser. No. 08/833,059 filed Apr. 3, 1997, the disclosure of which is incorporated herein by reference, now U.S. Pat. No. 6,046,423.

BACKGROUND OF THE INVENTION

1. Field of the Invention

The present invention relates to a switchgear in which an electrode opening or closing operation is performed when the electrode contacts or separates, particularly to a switchgear having a simplified structure and improved performance.

2. Description of the Related Art

FIGS. 25A and 25B show a switchgear similar to a conventional switchgear using electromagnetic repulsion as shown in Japanese Patent Publication No. 7-60624. Further, FIG. 25A shows the closed electrode state and FIG. 25B shows the opened electrode state.

In the figures, a switch 1 has a movable electrode 5 and a fixed electrode 6. The movable electrode 5 is fixed to a movable conductive rod 4. A repulsing section 2 is fixed to the movable conductive rod 4. A coil 3 for inducing current in the repulsing section 2 is fixed to a coil holder 9. The repulsing section 2 is pushed by a spring (coil spring) 8 so as to contact the movable electrode 5 with the fixed electrode 6. One end portion of the movable conductive rod 4 is inserted into a latch 7. The repulsing section 2, movable conductive rod 4, and movable electrode 5 are fixed and constituted on the axis of the electrodes 5 and 6. The coil 3 is connected to magnetic-field generating power supply.

Next, FIG. 26 is an illustration showing load characteristics of a coil spring used as the loading spring 8. In FIG. 26, numeral 49 denotes deflection of the spring used, 50 denotes deflection in an electrode closed state, 51 denotes deflection in the opened electrode state, 52 denotes a spring load under the closed electrode state, and 53 denotes a spring load under the opened electrode state.

Next, the operation will be described. In FIGS. 25A and 25B, when current is supplied to the coil 3, a magnetic field is generated. Thereby, an induced current is generated in the repulsing section 2 to provide an electromagnetic repulsion against the coil 3. When the electromagnetic repulsion exceeds the spring load 52 during the closed electrode state shown in FIG. 26, the repulsing section 2, movable conductive rod 4, and movable electrode 5 operate in the same direction as the electromagnetic repulsion and the switch 1 opens. Then, the latch 7 keeps the positions of the repulsing section 2, movable conductive rod 4, and movable electrode 5 in an opened electrode state, the switch 1 can then be closed in accordance with the load of the loading spring 8 by releasing the latch 7. As shown in FIG. 26, because the spring constant of the coil spring is constant, the spring load 53 in the opened electrode state exceeds the load 52 under the closed electrode state.

As described above, because the conventional switchgear uses the coil spring as the loading spring 8 and the spring load under the opened electrode state is larger than that under the closed electrode state, the spring energy must be large while the closed electrode state changes to the opened electrode state, therefore requiring unnecessary electromagnetic repulsion energy. Moreover, conventional switchgear needs a latch mechanism to maintain the opened electrode state. Therefore, when the electrode opening speed increases, the latch performance can not keep up with the speed and thus, the opened electrode state cannot be maintained. Furthermore, because the closing operation is performed by releasing the latch 7, there are problems in that it takes time for the latch releasing mechanism to begin operation, delaying the closing operation.

SUMMARY OF THE INVENTION

The present invention has been achieved with a view toward solving the problems described above, and it is an object of the present invention to provide a switchgear which is capable of reducing the spring energy needed to change from a closed electrode state to an opened electrode state as well as reducing the load on a latch or eliminating the latch to perform a fast opening/closing operation.

To this end, according to one aspect of the present invention, there is provided a switchgear, comprising: a pair of electrodes; a tripping mechanism for opening the electrodes; an opened electrode state holding mechanism for holding the electrodes open; a closing mechanism for closing the electrodes; and a loading spring for loading the electrodes; wherein the spring constant of the loading spring can be changed during closing and opening operations.

According to another aspect of the present invention, there is provided a switchgear, comprising: a pair of electrodes; a tripping mechanism for opening the electrodes; an opened electrode state holding mechanism for holding the electrodes open; and a closing mechanism for closing the electrodes; wherein the opened electrode state holding mechanism uses a loading spring in which a load in the opposite direction to the load under the closed state works under the opened electrode state.

According to a still further aspect of the present invention, there is provided a switchgear comprising a pair of electrodes, a tripping mechanism for opening the electrodes, and a closing mechanism for closing the electrodes; wherein the tripping mechanism and the closing mechanism are provided with a repulsing section and an electrode closing coil and an electrode opening coil for generating a repulsive force in the repulsing section, or provided with an electrode-closing repulsing section, an electrode-opening repulsing section, and an electrode closing-and-opening coil for generating a repulsive force in both repulsing sections, and an electrode closing capacitor for supplying current to the electrode closing coil or the electrode closing-and-opening coil when closing the electrode, an electrode opening capacitor for supplying current to the electrode opening coil or the electrode closing coil when opening the electrode, and a charging power supply for charging the electrode closing and opening capacitors.

According to a still further aspect of the present invention, there is provided a switchgear comprising a pair of electrodes, a tripping mechanism for opening the electrodes, and a closing mechanism for closing the electrodes; wherein the tripping mechanism and closing mechanism provided with a repulsing section and an electrode closing coil and electrode opening coil for generating a repulsive force in the repulsing section, and a capacitor for supplying current to the closing coil or electrode opening coil, a charging power supply for charging the capacitor, and closing and electrode-opening change means for selectively changing electrode-opening and closing operations so that current can be supplied from the capacitor to the closing coil or electrode opening coil.

DETAILED DESCRIPTION OF THE PREFERRED EMBODIMENTS

The embodiments according to the present invention will now be described with reference to the accompanying drawings.

First Embodiment

Figure 1A:
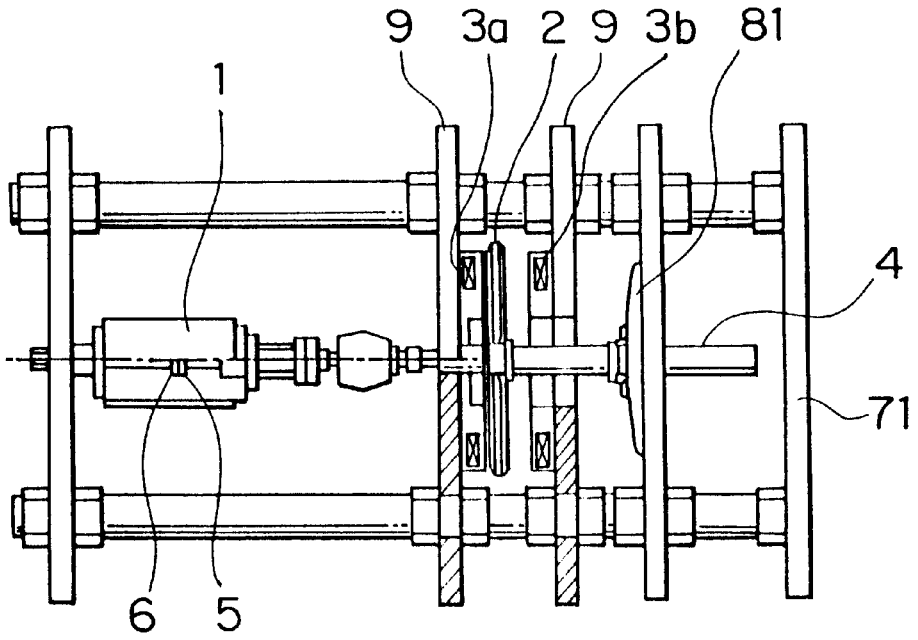
FIG. 1A is a side view showing a closed electrode state of a switchgear according to a first embodiment of the present invention.
Figure 1B:
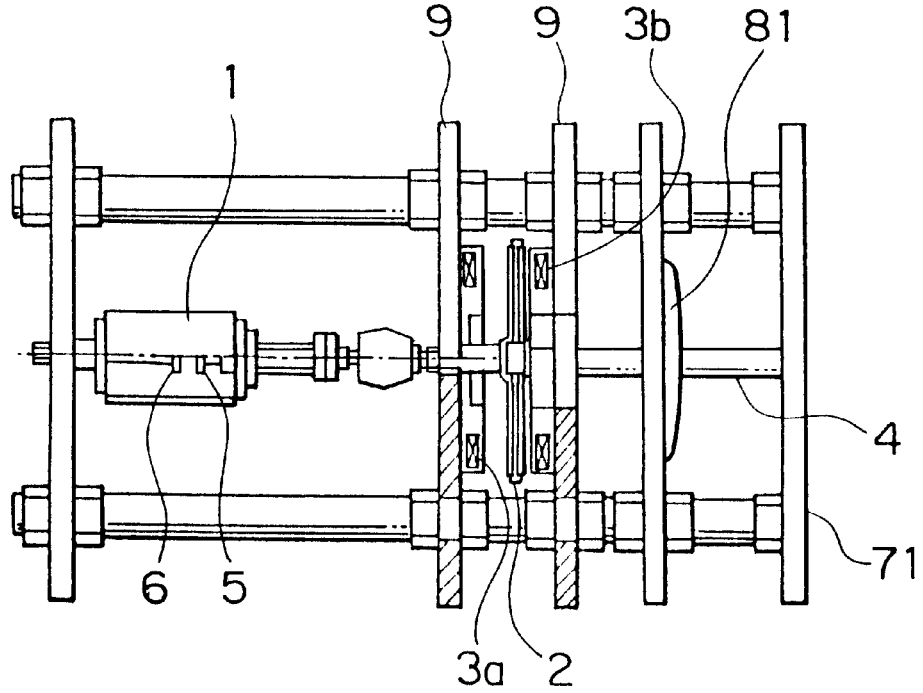
FIG. 1B is a side view showing an opened electrode state of FIG. 1A.

FIG. 1A is a side view showing a closed electrode state of a switchgear according to a first embodiment of the present invention. FIG. 1B is a side view showing an opened electrode state of FIG. 1A.

In the figures, a switch 1 has a movable electrode 5 and a fixed electrode 6. The movable electrode 5 is fixed to a movable conductive rod 4. A repulsing section 2 is fixed to the movable conductive rod 4. Coils 3*a* and 3*b* opposing both surface of the repulsing section 2 are fixed to a pair of coil holders 9 respectively. A loading spring 81 is attached to the movable conductive rod 4. One end portion of the movable conductive rod 4 contacts with and separates from a stopper 71.

Figure 2:
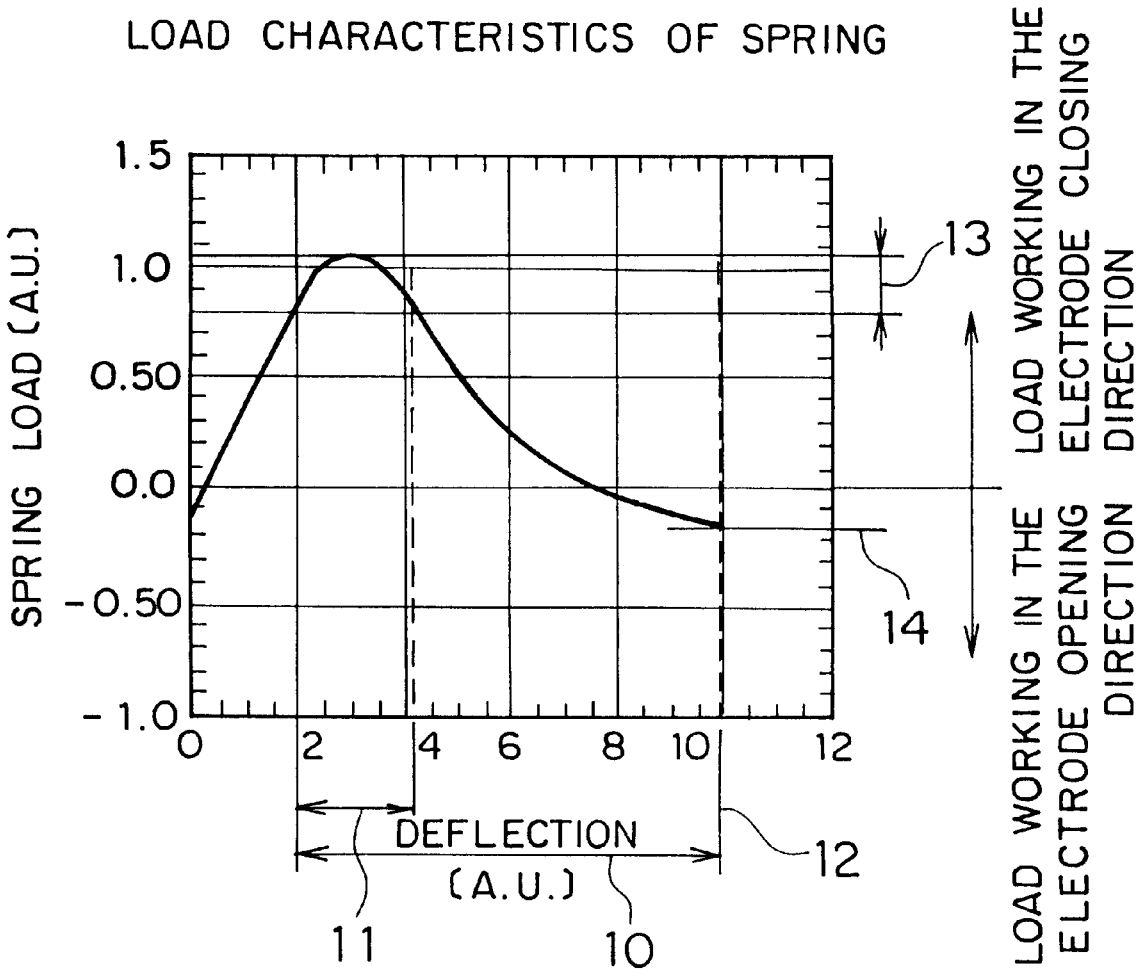
FIG. 2 is an illustration showing load characteristics of a loading spring of the first embodiment.

FIG. 2 is an illustration showing the load characteristics of the loading spring 81 of the first embodiment. Numeral 10 denotes deflection of the loading spring used, 11 denotes deflection range in the closed electrode state, 12 denotes deflection in the opened electrode state, 13 denotes spring load in the closed electrode state, and 14 denotes spring load in the opened electrode state.

The load of the loading spring 81 has its maximum value in the deflection range 11 and comes to the load 14 at the deflection 12 under the opened electrode state. A conical spring or flat spring is used so as to increase the load in the electrode opening direction. Needless to say, any other type of spring can be used if it has the same characteristics, that is, a spring whose spring constant is not constant between electrode opening and closing (i.e. a spring whose spring constant changes) can be used.

Moreover, it is permitted to superpose a plurality of loading springs over each other in order to increase the deflection value.

Figure 3:
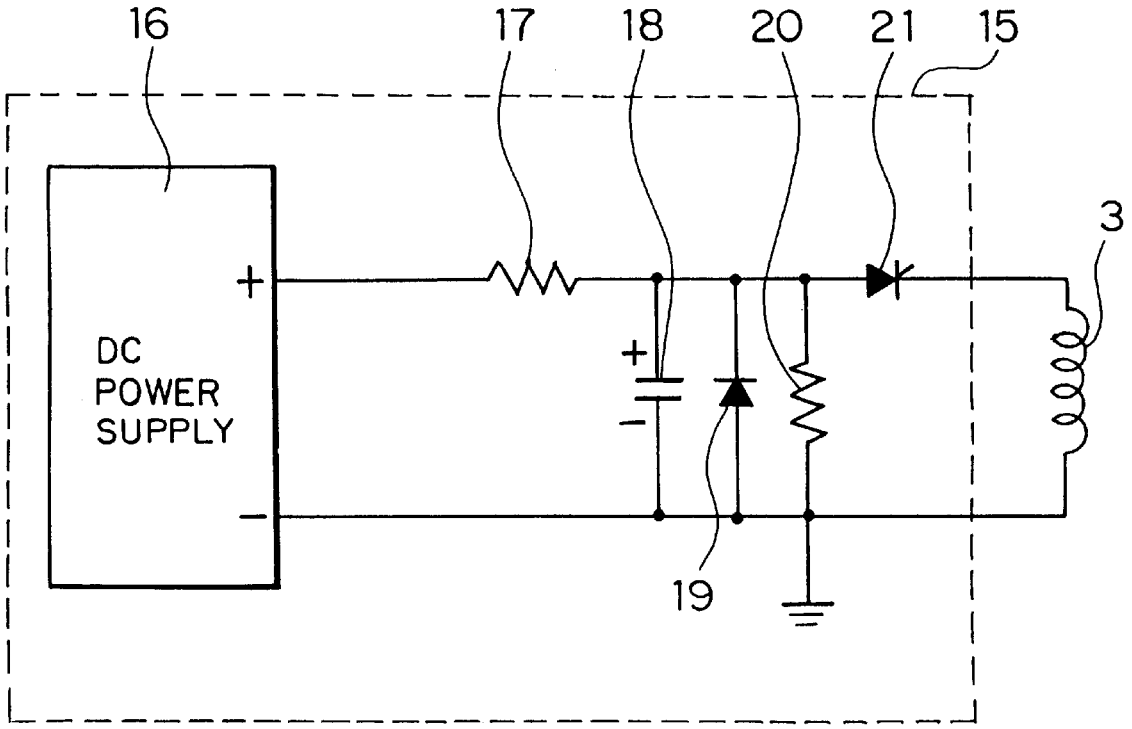
FIG. 3 is a circuit diagram showing a power supply for a coil of the first embodiment.

Further, FIG. 3 is a circuit diagram showing a power supply for a general coil.

In FIG. 3, a power supply 15 is provided with a DC power supply 16 for charging, a charging resistance 17, a charging capacitor 18, a diode 19, discharging resistance 20 and a thyristor switch 21. A coil 3 is the same as the coils 3*a* and 3*b* in FIG. 1.

Next, the electrode opening operation will be described.

In FIG. 1A, a magnetic field is generated by supplying an irregular current to the coil 3*a*. As a result, an eddy current is generated in the repulsing section 2 and the repulsing section 2 receives an electromagnetic repulsive force rightward in the drawing from coil 3*a*. When the electromagnetic repulsion exceeds the spring load range 13 under the closed electrode state shown in FIG. 2, the spring 81 operates in the electrode opening direction, the movable electrode 5 moves rightward in the drawing, and the switch 1 starts opening.

In FIG. 2, when the load of the loading spring decreases as the switch 1 further opens and the small deflection becomes equal to the deflection 12 in the opened electrode state, the direction of the spring load 14 in the opened electrode state is reversed and a load is applied in the electrode opening direction.

In this case, an irregular current is supplied to the coil 3*b* to stop the movable electrode 5 and the repulsing section 2 is decelerated by receiving an electromagnetic repulsive force leftward in the drawing from the coil 3*b*.

In FIG. 1B, the portion connected with the movable conductive rod 4 contacts and is stopped by the stopper 71 in the electrode opening direction. Therefore, a stable opened electrode state is realized.

Next, the electrode closing operation will be described.

In FIG. 1B, a magnetic field is generated by supplying an irregular current to the coil 3*b*. As a result, an eddy current is generated in the repulsing section 2 and the repulsing section 2 receives an electromagnetic repulsive force leftward in the drawing from the coil 3*b*. In FIG. 2, when the electromagnetic repulsion exceeds the spring load 14 under the opened electrode state, the spring 81 operates in the closing direction, the movable electrode 5 moves leftward in the drawing, and the switch 1 starts closing.

In FIG. 2, when the deflection reaches the range in which a load works in the closing direction as the switch 1 further closes, the switch 1 is closed by the load of the spring 81. In this case, current is supplied to the coil 3*a* to stop the movable electrode 5 and the repulsing section 2 is decelerated by receiving an electromagnetic repulsive force rightward in the drawing from the coil 3*a*.

As described above, by using a spring in which the spring load 14 under the opened electrode state is smaller than or equal to the spring load range 13 under the closed electrode state for the loading spring 81, the spring energy from the closed electrode state to the opened electrode state decreases in contrasts to the case of using the conventional coil spring 8 in which the spring load under the opened electrode state is larger than the spring load under the closed electrode state. Therefore, it is also possible to reduce the electromagnetic repulsion energy required to go from the closed electrode state to the opened electrode state.

Moreover, it is possible to downsize the coil 3 and the charging capacitor 18 in the power supply 15 of the coil in FIG. 3. Therefore, it is possible to downsize the power supply 15 of the coil and decrease the time needed to initiate electrode opening after an electrode opening command because the capacitance and inductance are also decreased and the rise time of the current to be supplied to the coil 3 decreases.

Furthermore, at the time of closing the switch 1, the impact produced when the movable electrode 5 contacts the fixed electrode 6 also decreases and welding due to chattering is prevented, to decrease the mechanical load and lengthen the service life of the switch 1.

Furthermore, by using a spring which works in the opened electrode state in the opposite direction to the load in the closed electrode state, it is possible to securely keep an electrode open in the opened electrode state, decrease the load of the latch 7 of the above conventional example, and do without the use of the mechanism of the latch 7. Furthermore, because an electromagnetic repulsion can easily be introduced into a closing mechanism by dispensing with the mechanism of the latch 7, the time required until closing can be decreased.

In FIG. 1B, by supplying a larger current to the coil 3*b*, the repulsing section 2 receives a larger electromagnetic repulsive force against the coil 3*b*, and the closing speed is further raised, and thus it is possible to prevent a preceding discharge at the time of closing.

As described above, the first embodiment has advantages in that the spring energy from the closed electrode state to the opened electrode state decreases and therefore, the electromagnetic repulsion energy of a coil is reduced and thus, it is possible to downsize the coil power supply and lengthen the service life of a switch. Moreover, it is possible to eliminate a latch mechanism and there is an advantage that a switchgear with high-speed opening and closing operations can be obtained.

A modification of the first embodiment is described below.

Figure 5:
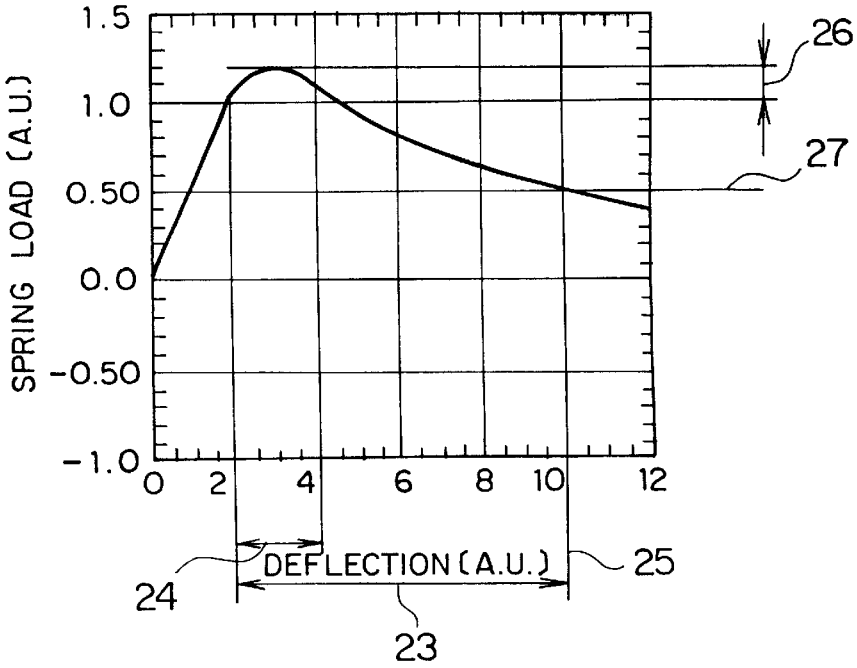
FIG. 5 is an illustration showing load characteristics of a loading spring of the second embodiment.
Figure 25A:
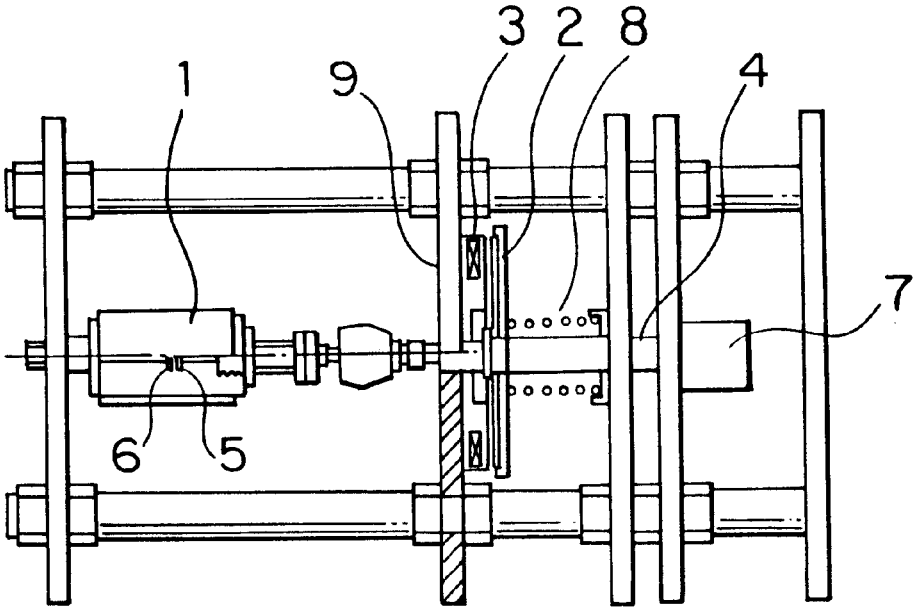
FIG. 25A PRIOR ART
FIG. 25A is a side view showing a closed electrode state of a conventional switchgear.
Figure 25B:
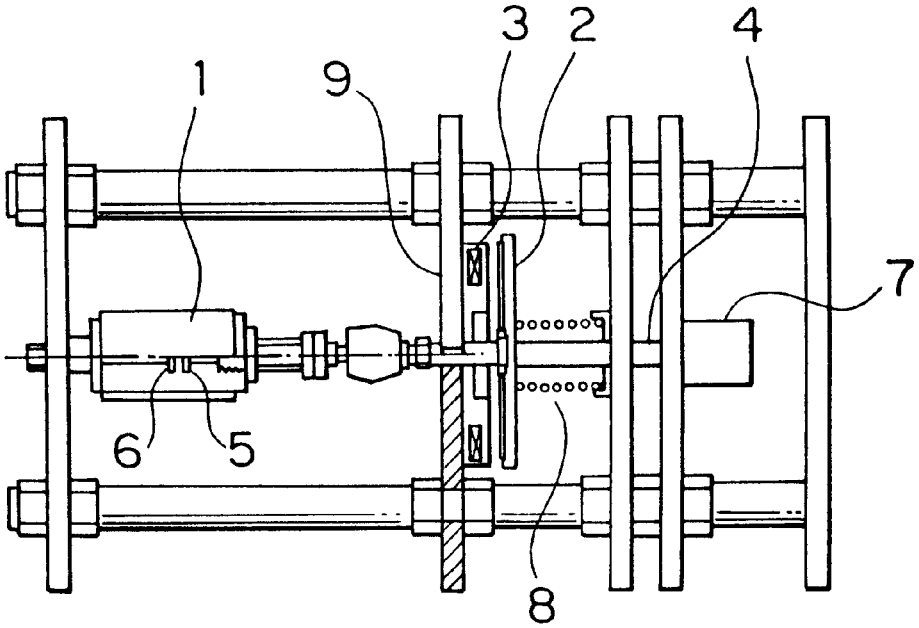
FIG. 25B PRIOR ART
FIG. 25B is a side view showing an opened electrode state of FIG. 25A.
Figure 26:
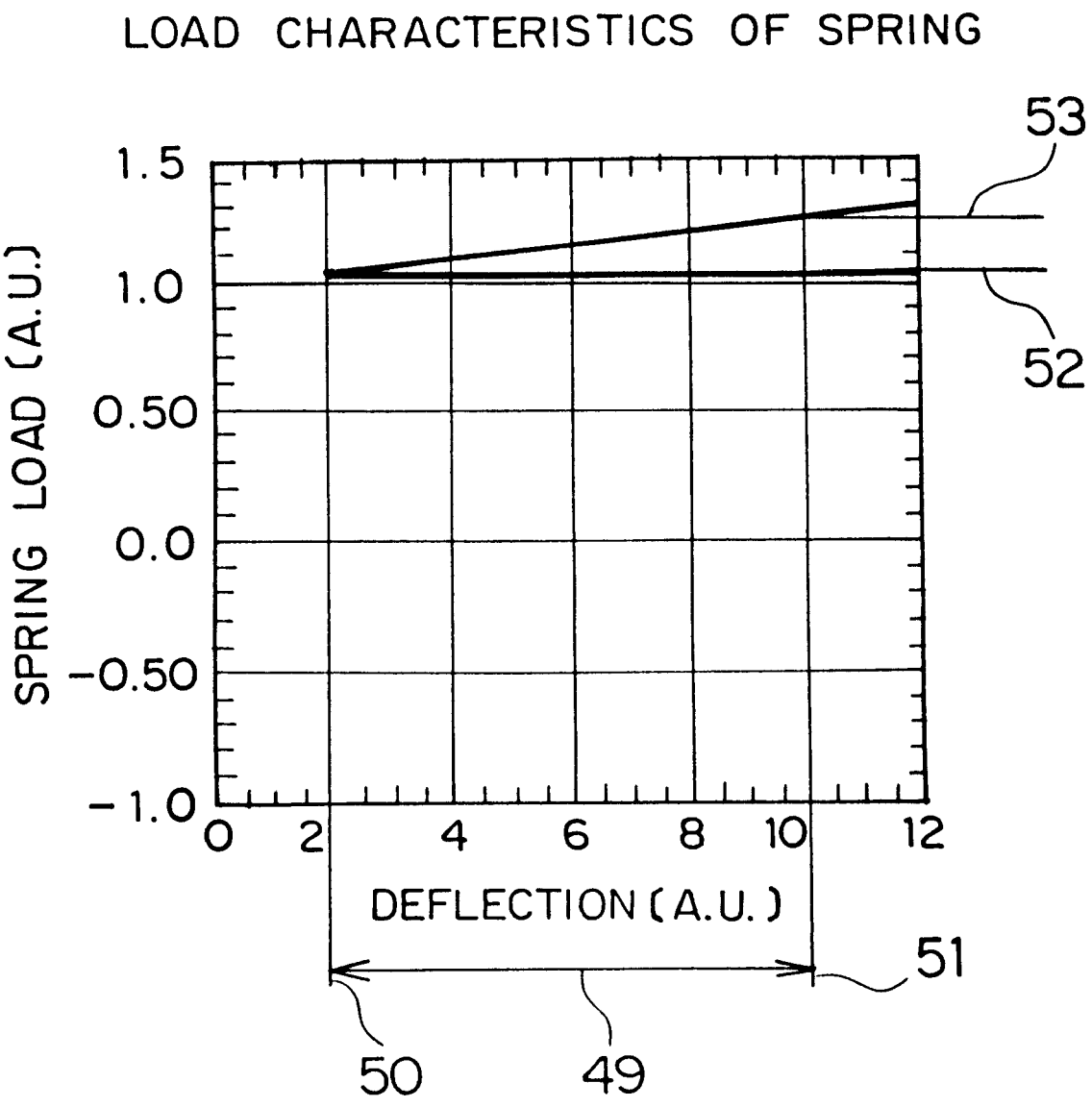
FIG. 26 PRIOR ART
FIG. 26 is an illustration showing load characteristics of a loading spring of FIGS. 25A and 25B.

Though a spring with the spring characteristic shown in FIG. 2 is used in the first embodiment for the loading spring 81, it is also possible to use a spring with the characteristic shown in FIG. 5 instead of the spring 81. In this case, because the spring load is applied in the same direction as the case of the closed electrode state even under the opened electrode state (the spring load is zero or more), an opened electrode state holding mechanism like the conventional latch 7 in FIGS. 25A and 25B is separately required.

Therefore, though the latch 7 cannot be omitted, there are advantages that the spring energy from the closed electrode state to the opened electrode state decreases and therefore, the electromagnetic repulsion energy of a coil is also reduced and thus, it is possible to downsize the coil power supply and lengthen the service life of a switch.

When there is a latch, the opened electrode state is securely held. Therefore, it is possible to maintain a high reliability.

Second Embodiment

For the first embodiment, a case was described in which one conical spring is used, that is, a loading spring has the function of an opened electrode state holding mechanism. However, even if a conical spring used for a loading spring and a conical spring used for an opened electrode state holding mechanism are arranged, it is possible to obtain advantages similar to those of the first embodiment.

Figure 4A:
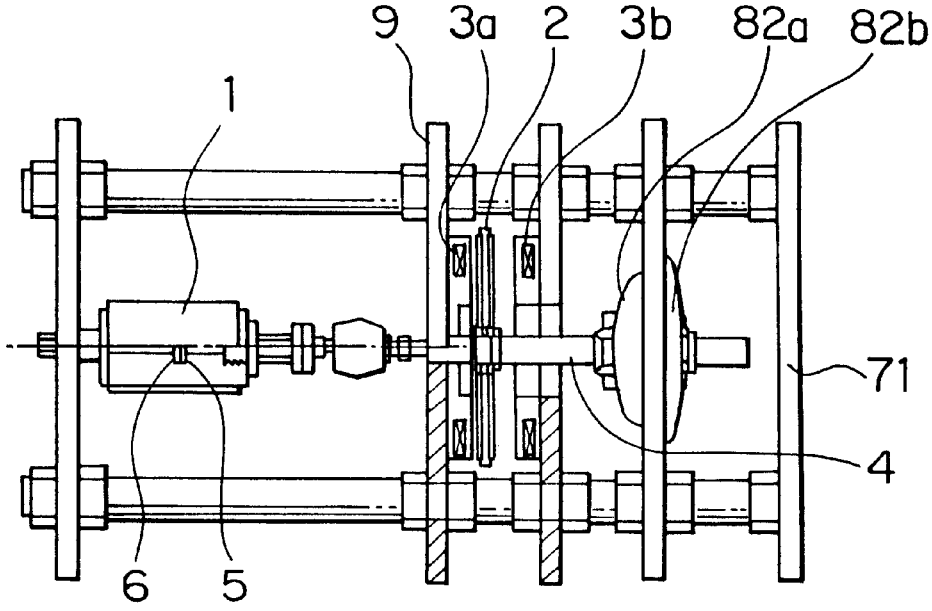
FIG. 4A is a side view showing a closed electrode state of a switchgear according to a second embodiment of the present invention.
Figure 4B:
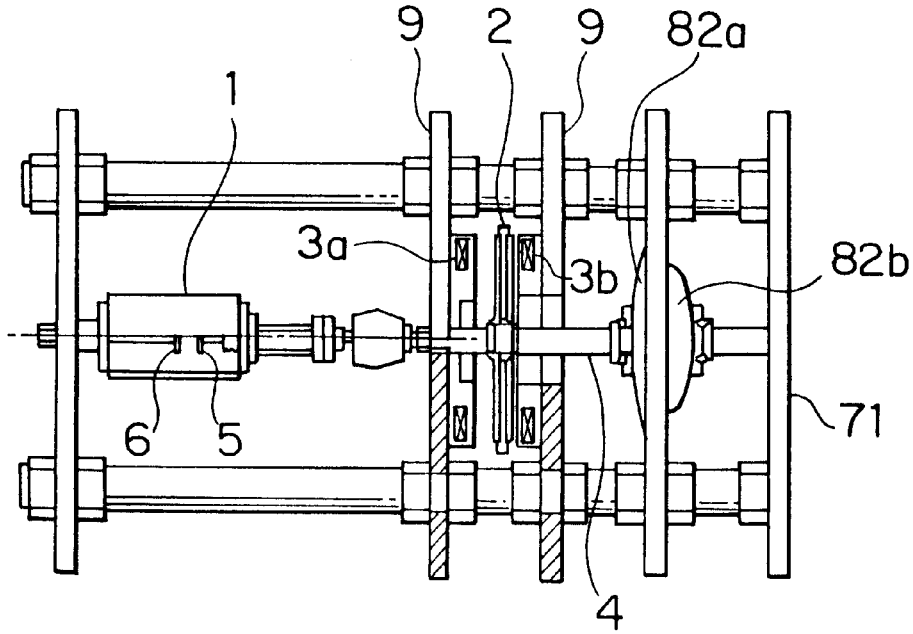
FIG. 4B is a side view showing an opened electrode state of FIG. 4A.

FIG. 4A is a side view showing a closed electrode state of a switchgear according to a second embodiment of the present invention. FIG. 4B is a side view showing the opened electrode state of FIG. 4A.

In the figures, a loading spring 82*a* and a spring 82*b* serving as an opened electrode state holding mechanism are attached to the movable conductive rod 4.

The loading spring 82*a* is set in the closing direction and the spring 82*b* serving as an opened electrode state holding mechanism is set in the electrode opening direction so that the load increases.

FIG. 5 is an illustration showing load characteristics of the loading spring 82*a*. Symbol 23 denotes a deflection of a spring used, 24 denotes a deflection range under the closed electrode state, 25 denotes a deflection under the opened electrode state, 26 denotes a spring load range under the closed electrode state, and 27 denotes a spring load under the opened electrode state. The load characteristic of the spring 82*a* has the maximum value in the deflection range 24 and the spring load range 26 under the closed electrode state and comes -to the spring load 27 for the deflection 25 under the opened electrode state.

In FIG. 5, the spring 82*a* uses a conical spring or a flat spring so that the spring load range 26 under the closed electrode state exceeds the spring load 27 under the opened electrode state. Moreover, it is needless to say that any other spring can be used as long as it has the same characteristic.

Furthermore, it is permitted to superpose a plurality of springs 82*a* on each other in order to increase the deflection value.

Figure 6:
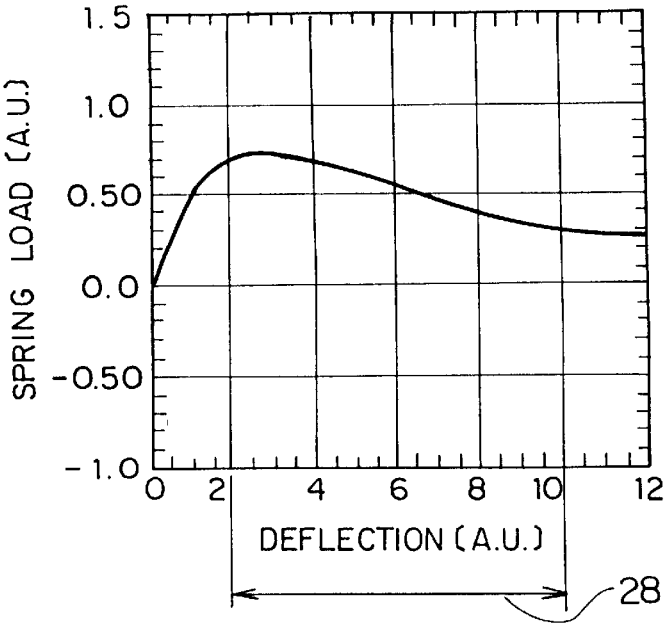
FIG. 6 is an illustration showing other load characteristics of the loading spring of the second embodiment.

Similarly, FIG. 6 is an illustration showing a load characteristic of the spring 82*b* for holding the opened electrode state. Symbol 28 denotes a deflection range of a spring used. The load characteristic of the spring 82*b* has a maximum value similar to the case of FIG. 2.

The spring 82*b* also uses a conical spring or flat spring the same as the spring 82*a* does. Moreover, it is needless to say that any other spring can be used as long as it has the same characteristics.

Furthermore, it is permitted to superpose a plurality of springs 82*b* on each other in order to increase the deflection value.

Figure 7:
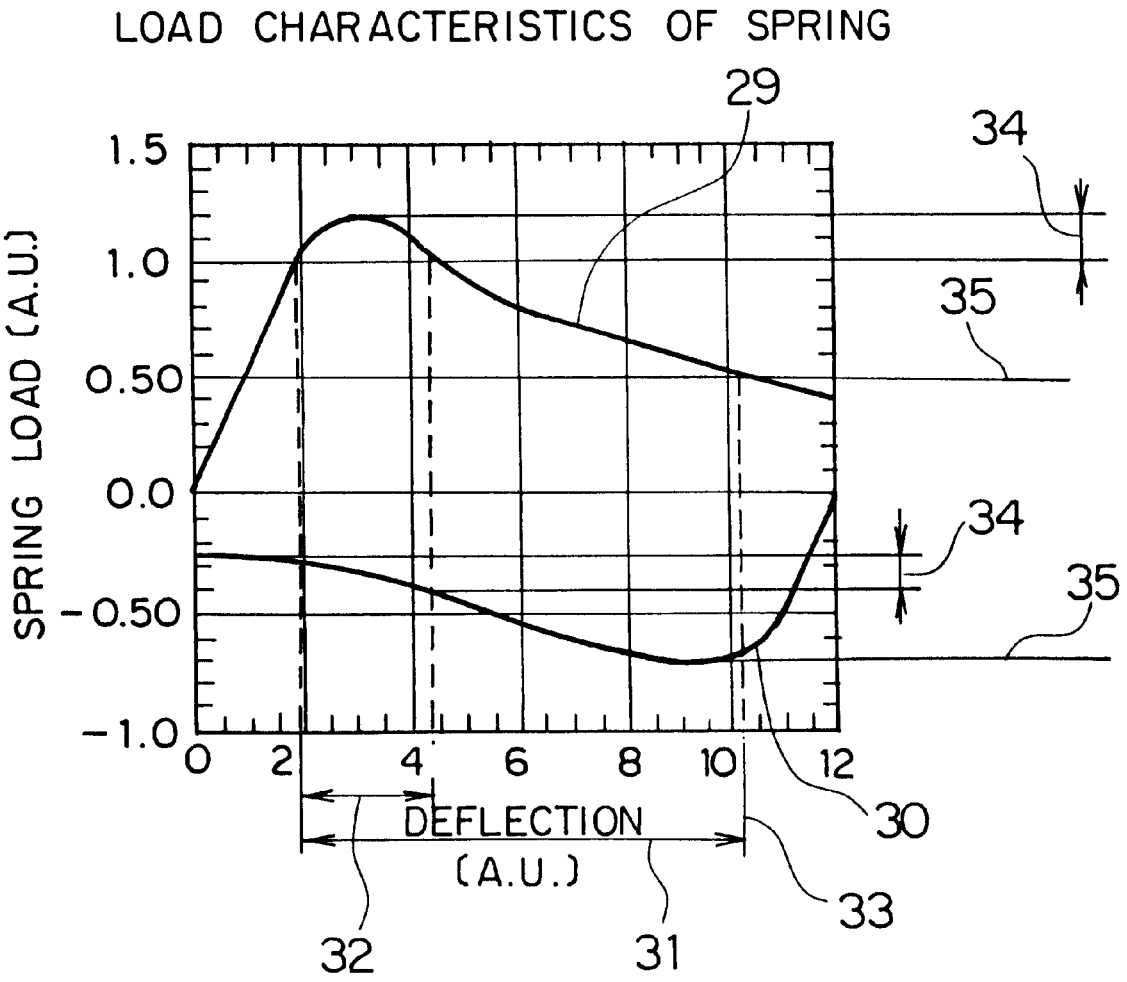
FIG. 7 is an illustration showing other load characteristics of the loading spring of the second embodiment.

FIG. 7 is an illustration showing load characteristics when arranging the spring 82*a* in the closing direction and the spring 82*b* in the electrode opening direction so that the load increases.

Numeral 29 denotes a spring having the characteristics in FIG. 5, which is the spring 82*a* in FIG. 4A and 30 denotes a spring having the characteristics in FIG. 6, which is the spring 82*b* in FIG. 4A.

Symbol 31 denotes deflection range of the spring used, 32 denotes deflection range in the closed electrode state, 33 denotes deflection in the opened electrode state, 34 denotes spring load range in the closed electrode state, and 35 denotes spring load in the opened electrode state.

The spring 29 having the characteristics in FIG. 5 is arranged so that the load range 34 of the spring 29 exceeds the load range 34 of the spring 30 having the characteristics in FIG. 6. Moreover, the spring 29 having the characteristics in FIG. 5 is arranged so that the load 35 of the spring 29 exceeds the load 35 of the spring 30 having the characteristics in FIG. 6.

Figure 8:
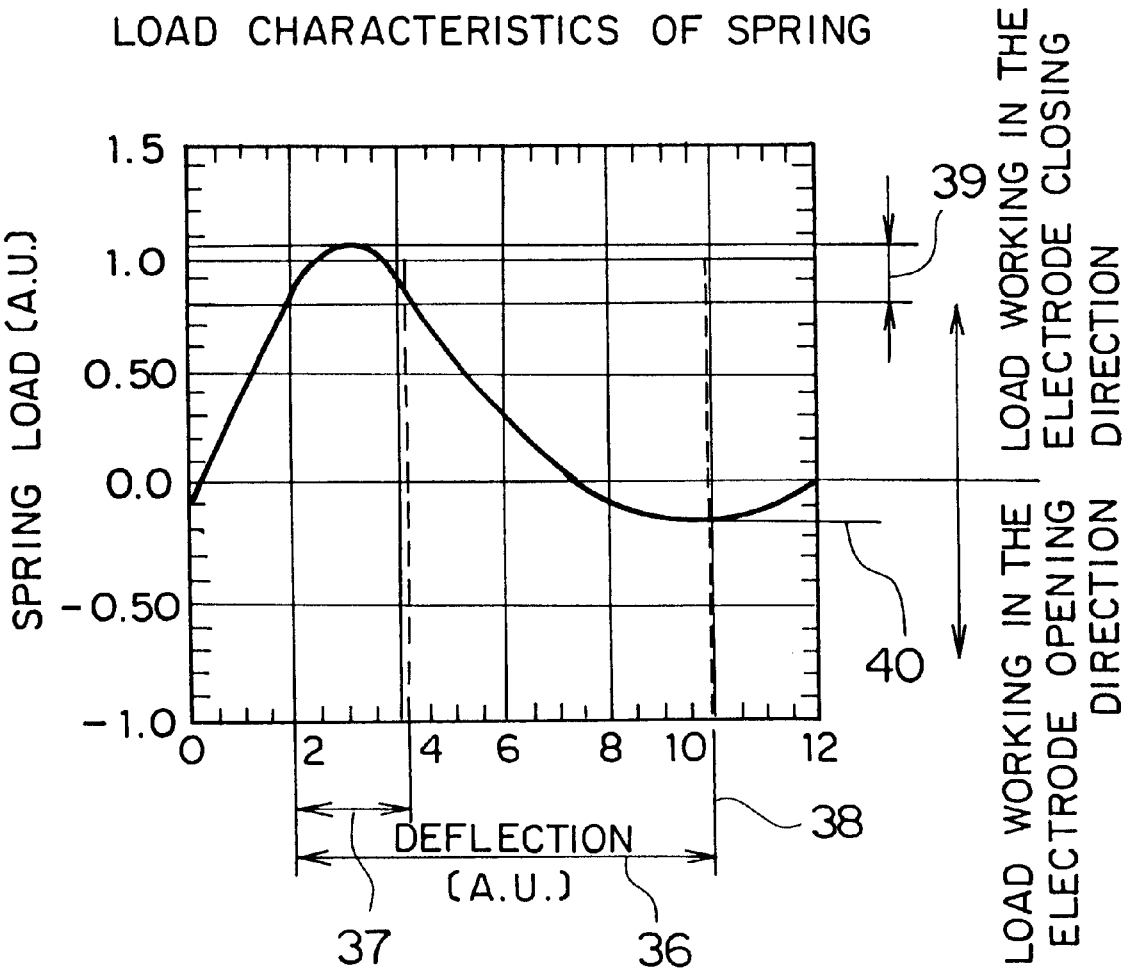
FIG. 8 is an illustration showing still other load characteristics of the loading spring of the second embodiment.

FIG. 8 is an illustration showing the composite load characteristics when arranging the springs 82*a* and 82*b* as shown in FIGS. 4A and 4B.

Numeral 36 denotes deflection range of the spring used, 37 denotes deflection range in the closed electrode state, 38 denotes deflection in the opened electrode state, 39 denotes spring load range in the closed electrode state, and 40 denotes spring load in the opened electrode state.

When the first embodiment uses a conical spring as the loading spring 81, the spring 81 turns inside out in the closed electrode state in comparison to the opened electrode state and the loading spring 81 is easily fatigued and thereby, its service life is shortened.

By arranging the springs 82*a* and 82*b* so as to face each other as shown in FIG. 8, the springs 82*a* and 82*b* do not turn inside out in the closed electrode state in comparison to the opened electrode state, their service lives are lengthened, and characteristics similar to those of the loading spring 81 in FIGS. 1A and 1B can be obtained.

Next, the operation will be described.

The operation of the second embodiment is basically the same as that of the first embodiment. First, the electrode opening operation is described. In FIG. 4A, when current is supplied to the coil 3*a*, the repulsing section 2 receives an electromagnetic repulsive force rightward in the drawing from the coil 3*a*. When the electromagnetic repulsive force exceeds the spring load range 39 under the closed electrode state shown in FIG. 8, the spring 82*a* operates in the electrode opening direction and thereby, the movable electrode 5 moves rightward on the drawing and the switch starts opening.

In FIG. 8, when the load of the loading spring decreases as the switch 1 further opens and the small deflection reaches the deflection 38 in the opened electrode state, the load 40 of the spring under the opened electrode state is applied in the electrode opening direction and the opened electrode state is realized.

Next, the closing operation is described below.

In FIG. 4B, when current is supplied to the coil 3*b*, the repulsing section 2 receives an electromagnetic repulsive force leftward in the drawing from the coil 3*b*.

As shown in FIG. 8, when the electromagnetic repulsive force exceeds the spring load 40 under the opened electrode state, the spring 82*b* operates in the closing direction and thereby, the movable electrode 5 moves leftward in the drawing and the switch 1 starts closing.

In FIG. 8, when the deflection enters the range of the load working in the closing direction as the switch 1 further closes, the switch 1 is closed due to the load of the spring 82*b*.

Third Embodiment In the case of the second embodiment, a conical spring and a coil spring are used as the loading spring and opened electrode state holding mechanism respectively. However, even by using a conical spring as a loading spring and a coil spring as an opened electrode state holding mechanism, it is possible to obtain advantages similar to those of the first embodiment.

Figure 9A:
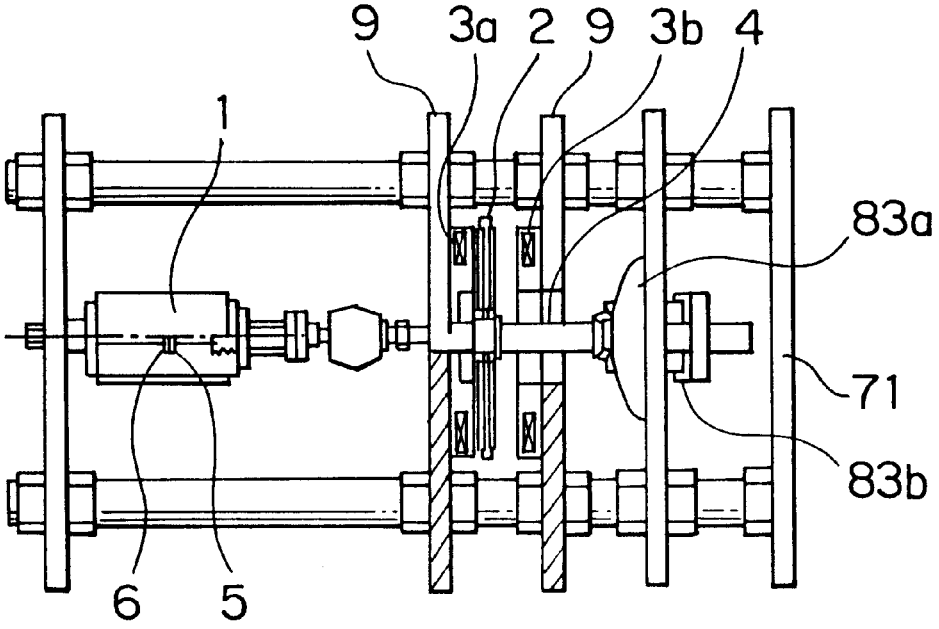
FIG. 9A is a side view showing a closed electrode state of a switchgear according to a third embodiment of the present invention.
Figure 9B:
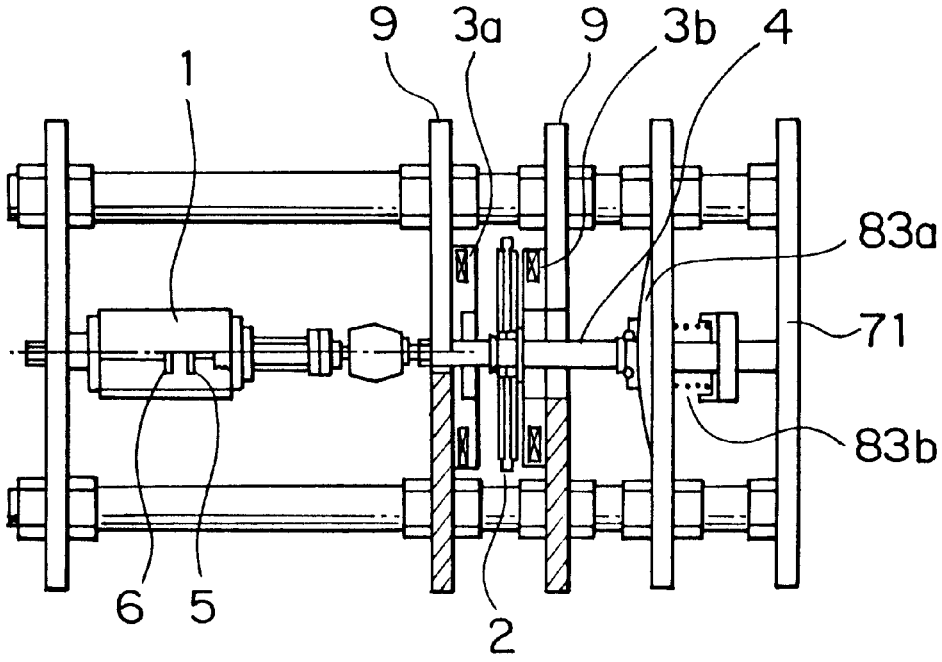
FIG. 9B is a side view showing an opened electrode state of FIG. 9A.

FIG. 9A is a side view showing a closed electrode state of a switchgear according to a third embodiment of the present invention. FIG. 9B is a side view showing the opened electrode state of FIG. 9A.

In the figures, a spring 83*b* serving as an opened electrode state holding mechanism has load characteristics similar to that of the conventional coil spring 8 and is used instead of the spring 82*b* of the second embodiment. The loading spring 83*a* is set in the closing direction and the spring 83*b* serving as an opened electrode state holding mechanism is set in the electrode opening direction so that the load increases.

Figure 10:
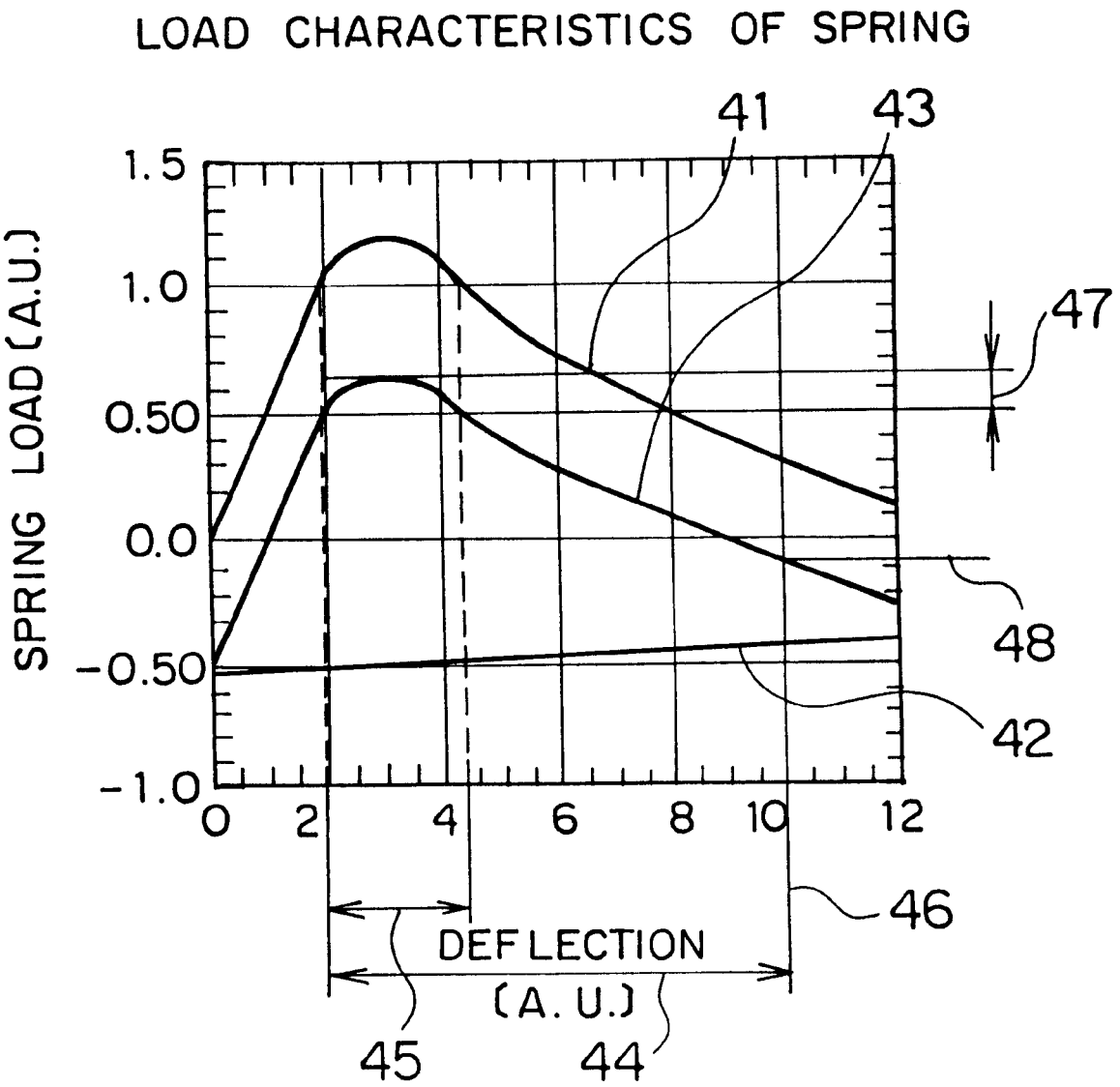
FIG. 10 is an illustration showing load characteristics of a loading spring of the third embodiment.

FIG. 10 shows load characteristics of the springs 83*a* and 83*b* in FIGS. 9A and 9B. In FIG. 10, numeral 41 denotes load characteristics of the spring 83*a*, 42 denotes load characteristics of the spring 83*b*, and 43 denotes load characteristics obtained by combining the load characteristics of the springs 83*a* and 83*b*.

Moreover, numeral 44 denotes deflection range of a spring used, 45 denotes deflection range in the closed electrode state, 46 denotes deflection in the opened electrode state, 47 denotes spring load range in the closed electrode state, and 48 denotes spring load in the opened electrode state.

The load characteristics of a spring has the maximum value in the deflection range 45 under the closed electrode state and the range 43 of a spring load under the closed electrode state and comes to the spring load 48 under the opened electrode state at the deflection 46 under the opened electrode state. The spring 83*a* uses a conical spring or flat spring so that the spring load 43 under the closed electrode state exceeds the spring load 48 under the opened electrode state. However, it is needless to say that any other spring can be used as long as it has the same characteristics.

Moreover, it is permitted to superpose a plurality of springs 83*a* on each other in order to increase the deflection value.

When the first embodiment uses a conical spring as the loading spring 81, the spring 81 turns inside out under the closed electrode state in comparison to the opened electrode state, it is easily fatigued, and therefore its service life is not long.

By arranging the springs 83*a* and 83*b* as shown in FIG. 9, the springs 83*a* and 83*b* will not turn inside out under the closed electrode state in comparison to the opened electrode state, their service life will be lengthened, and therefore it is possible to obtain characteristics similar to those of the loading spring 81 in FIG. 1.

Next, the operation will be described.

The operation of the third embodiment is basically the same as the first embodiment.

First, the electrode opening operation is described. In FIG. 9A, when current is supplied to the coil 3*a*, the repulsing section 2 receives an electromagnetic repulsive force rightward in the drawing from the coil 3*a*.

As shown in FIG. 10, when the electromagnetic repulsive force exceeds the spring load range 47 under the closed electrode state, the spring 83*a* operates in the electrode opening direction and thereby, the movable electrode 5 moves rightward in the drawing and the switch 1 starts opening.

In FIG. 10, when the load of the spring 83*a* decreases as the switch 1 further opens and the small deflection reaches the deflection 46 in the opened electrode state, the load 48 of the spring under the opened electrode state is applied in the electrode opening direction and the opened electrode state is realized.

Next, the closing operation is described below.

In FIG. 9B, when current is supplied to the coil 3*b*, the repulsing section 2 receives an electromagnetic repulsive force leftward in the drawing from the coil 3*b*.

As shown in FIG. 10, when the electromagnetic repulsive force exceeds the spring load 48 in the opened electrode state, the spring 83*b* operates in the closing direction and thereby, the movable electrode 5 moves leftward in the drawing and the switch 1 starts closing.

In FIG. 10, when the deflection enters the range of the load working in the closing direction, the switch 1 is closed due to the load of the spring 83*b*.

Fourth Embodiment

For the first, second and third embodiments, a case was described in which one repulsing section 2 is used. For this embodiment, however, a case is described in which a plurality of repulsing sections are used.

Figure 11A:
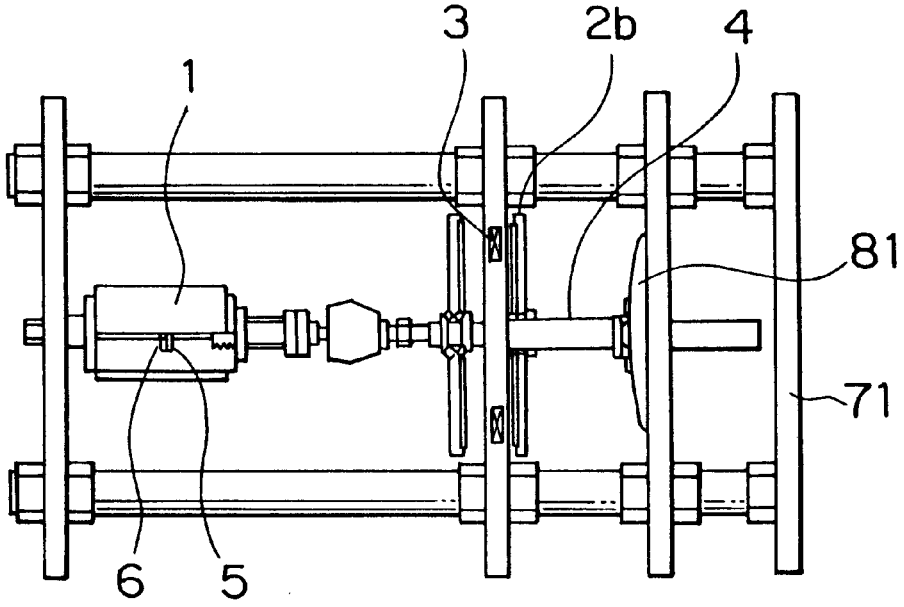
FIG. 11A is a side view showing a closed electrode state of a switchgear according to a fourth embodiment of the present invention.
Figure 11B:
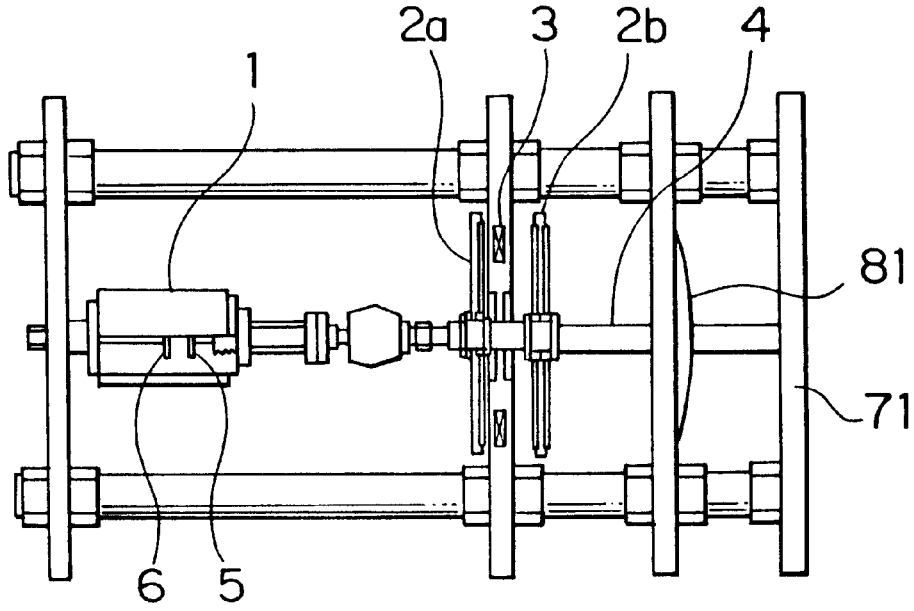
FIG. 11B is a side view showing an opened electrode state of FIG. 11A.

FIG. 11A is a side view showing a closed electrode state of a switchgear according -to a fourth embodiment of the present invention. FIG. 11B is a side view showing the opened electrode state of FIG. 11A.

In the figures, a plurality of repulsing sections 2*a* and 2*b* are provided at both sides of the coil 3. For this embodiment, a case is described in which the spring in FIG. 2 is used.

The electrode opening operation will now be described.

In FIG. 11A, when an irregular current is supplied to the coil 3, a magnetic field is generated. When an eddy current is produced due to the magnetic field, the repulsing section 2*b* receives an electromagnetic repulsive force rightward in the drawing from the coil 3. When the electromagnetic repulsive force exceeds the spring load range 13 under the closed electrode state shown in FIG. 2, the spring 81 operates in the electrode opening direction and thereby, the movable electrode 5 moves rightward in the drawing and the switch 1 starts opening.

In FIG. 2, when the load of the loading spring decreases as the switch 1 opens further and the small deflection comes to the deflection 12 under the opened electrode state, the load 14 of the spring under the opened electrode state is applied in the electrode opening direction. In this case, because the repulsing section 2*a* receives an electromagnetic repulsive force in the direction opposite to the working direction, that is, leftward in the drawing from the coil 3, the repulsing sections 2*a* and 2*b*, movable electrode rod 4, and movable electrode 6 are simultaneously decelerated and thereby, it is possible to decrease the total impact received by the switchgear.

In FIG. 11B, because the portion connected with the movable conductive rod 4 contacts the stopper 71 and it is pressed in the electrode opening direction and stops, stable opened electrode state is realized.

Next, the electrode closing operation will be described.

In FIG. 11B, when current is supplied to the coil 3, a magnetic field is generated. When an eddy current is produced in the repulsing section 2*a* due to the magnetic field, the section 2*a* receives an electromagnetic repulsive force leftward in the drawing from the coil 3. When the electromagnetic repulsive force exceeds the loading spring load range 14 under the opened electrode state, the spring 81 operates in the closing direction and thereby, the movable electrode 5 moves leftward in the drawing and the switch 1 starts closing.

In FIG. 2, when the deflection enters the range of the load working in the closing direction as the switch 1 further closes, the switch 1 is closed due to the load of the loading spring 81. In this case, because the repulsing section 2*b* receives an electromagnetic repulsive force from the coil 3 in the direction opposite to the working direction, that is, rightward in the drawing, the repulsing sections 2*a* and 2*b*, movable electrode rod 4, and movable electrode 6 are simultaneously decelerated and thereby, it is possible to decrease the total impact received by the switchgear.

As described above, according to the fourth embodiment, there is an advantage that a switchgear with less impact at the time of electrode opening or closing can be obtained. Moreover, because only one coil and only one power supply for the coil are used, there is an advantage that a switchgear smaller than the first, second and third embodiments can be obtained.

For the fourth embodiment, a case is described in which the spring of the first embodiment is used as a loading spring. However, it is needless to say that the same advantage can also be obtained by using the springs of the second or third embodiment.

Fifth Embodiment

Figure 12B:
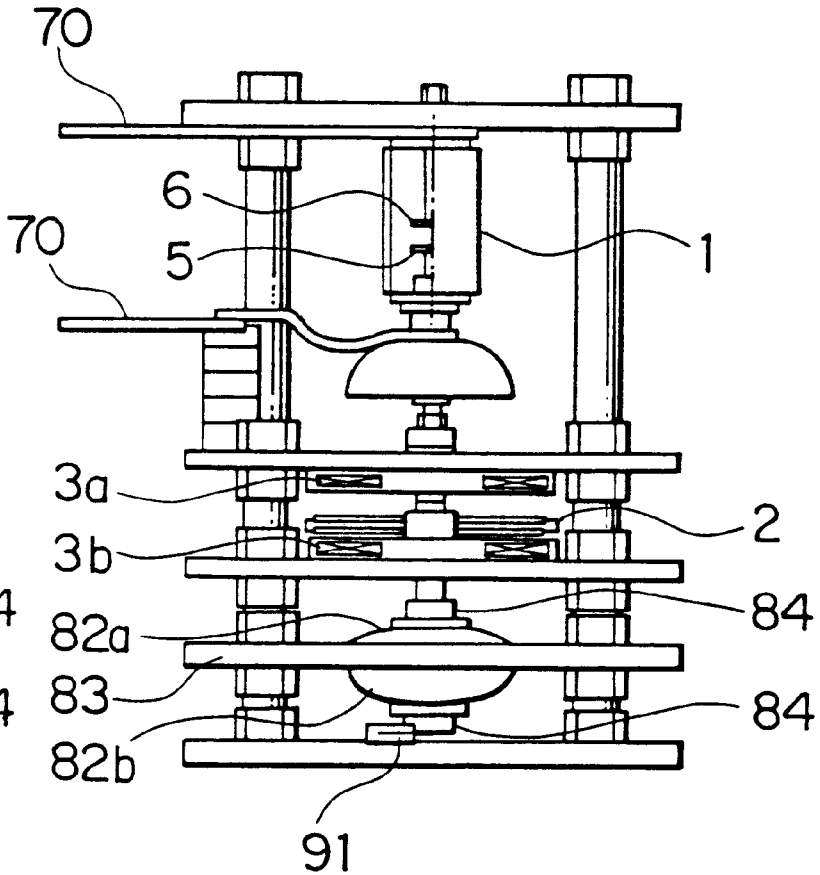
FIG. 12B is a side view showing an opened electrode state of FIG. 12A.
Figure 12A:
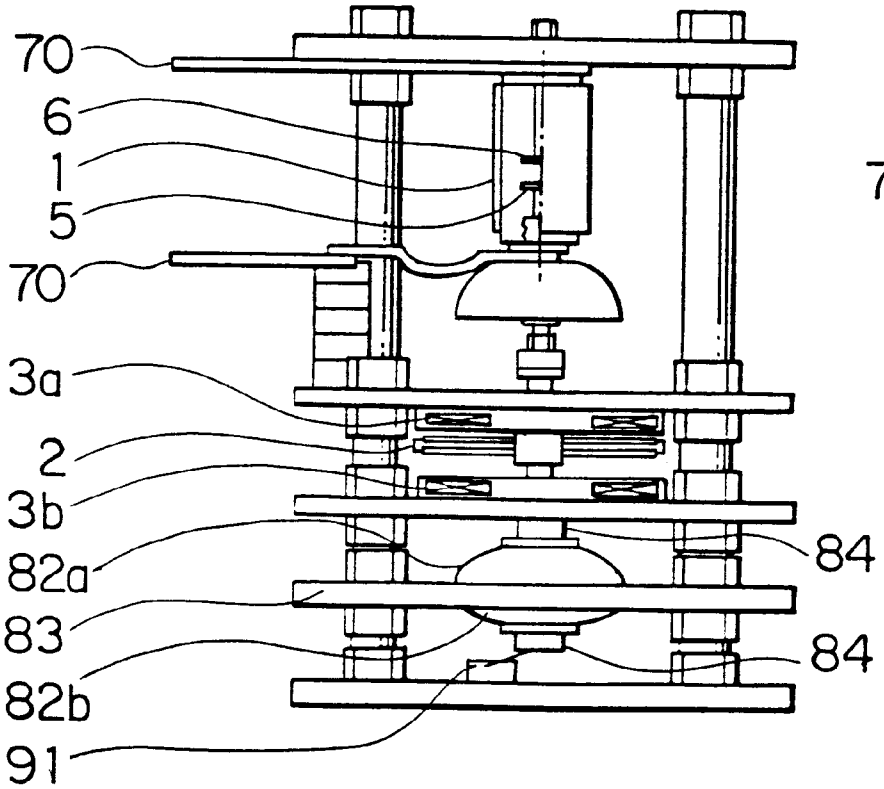
FIG. 12A is a side view showing a closed electrode state of a switchgear according to a fifth embodiment of the present invention.

FIG. 12A is a side view showing a closed electrode state of a switchgear according to a fifth embodiment of the present invention. FIG. 12B is a side view showing the opened electrode state of FIG. 12A.

In the figures, terminals 70 are connected to the electrodes 5 and 6. Loading springs 82*a* and 82*b*, i.e., conical springs are disposed at both sides of a seat plate 83. A limit switch 91 is also added to a conventional switchgear. However, washers 84 serve as a spring support for loading springs 82*a* and 82*b* in the case of this embodiment.

Figure 13B:
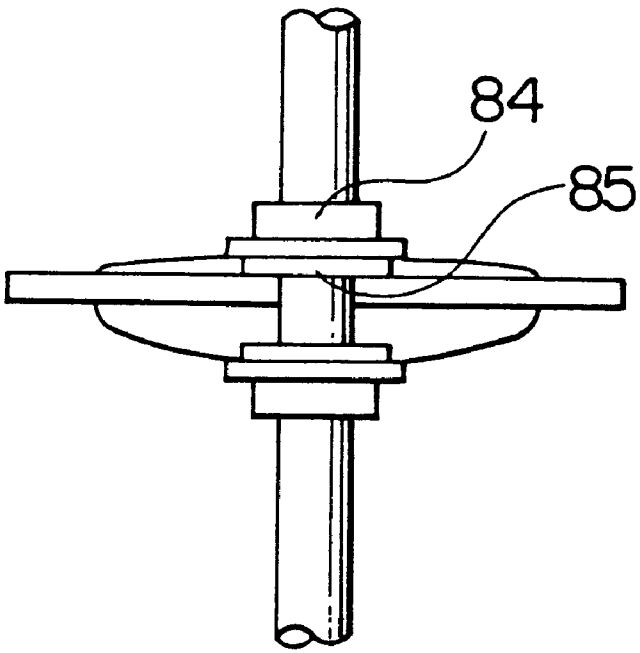
FIG. 13B is an enlarged view showing the opened electrode state of FIG. 13A.
Figure 13A:
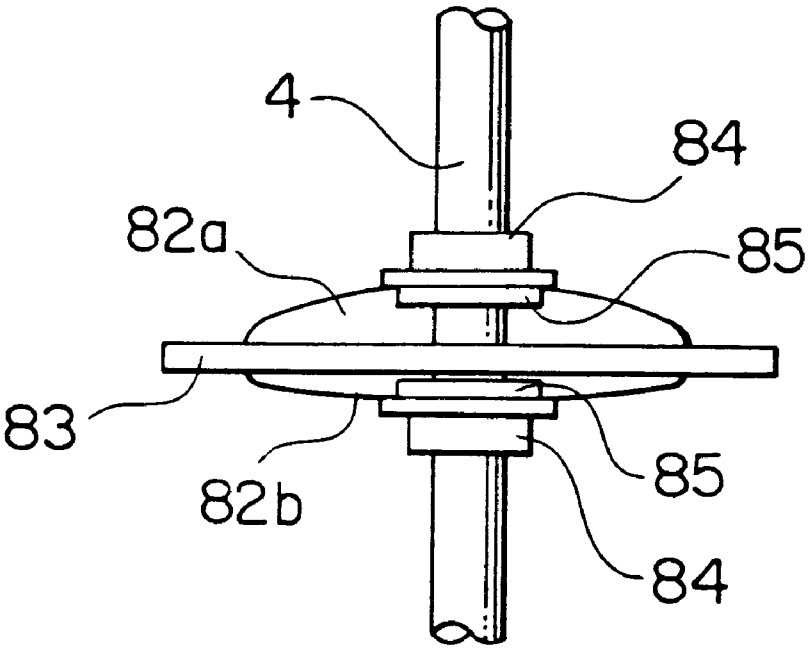
FIG. 13A is an enlarged view showing the closed electrode state of a loading spring of the fifth embodiment.
Figure 14B:
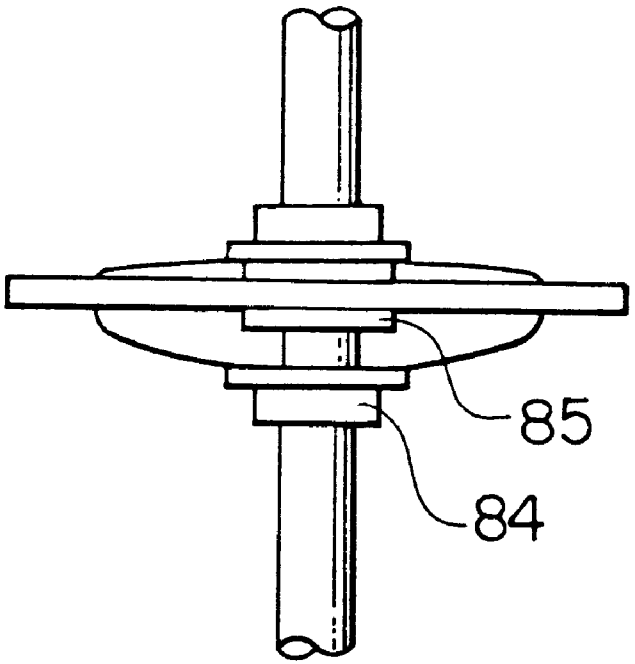
FIG. 14B is an enlarged view showing the opened electrode state of FIG. 14A.
Figure 14A:
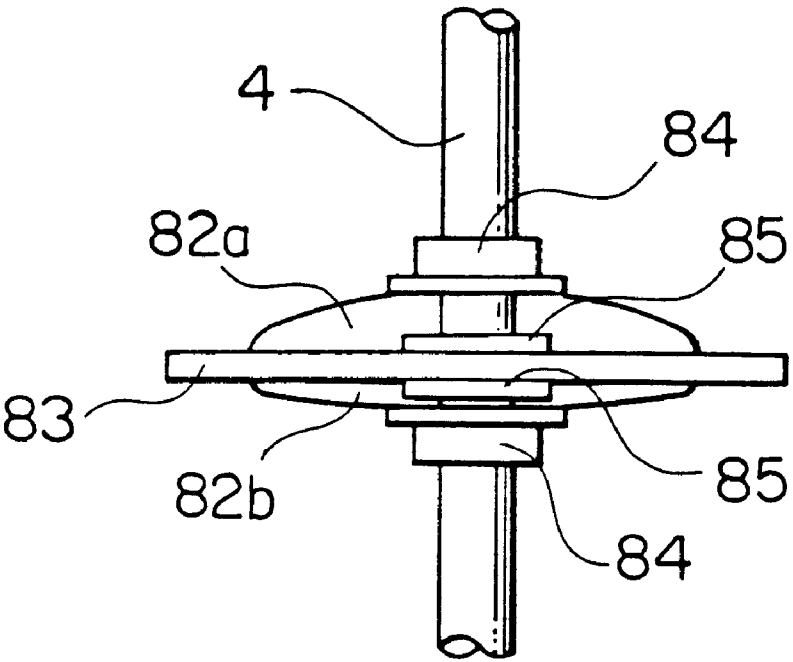
FIG. 14A is an enlarged view showing the closed electrode state of another loading spring of the fifth embodiment.

FIGS. 13A and 13B and FIGS. 14A and 14B are detailed illustrations of the loading springs 82*a* and 82*b*, in which FIGS. 13A and 14A show opened electrode states and FIGS. 13B and 14B show closed electrode states. In the figures, the staking lock 85 functioning as a stopper for controlling the deflection range of a conical spring, is added to the washer 84 in FIGS. 13A and 13B. Moreover, a staking lock 85 is added to the seat plate 83 in FIGS. 14A and 14B.

Figure 15A:
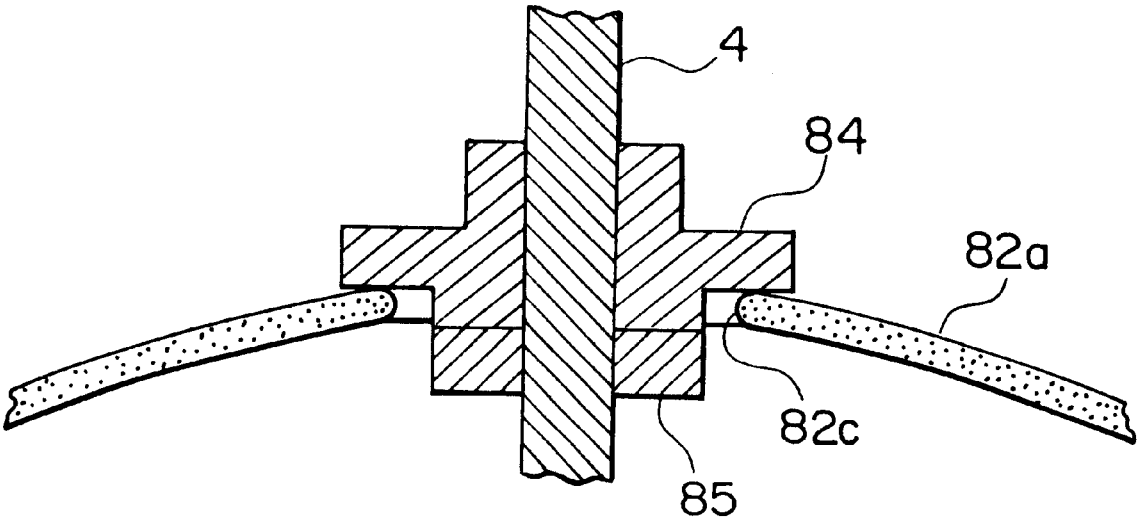
FIG. 15A is a cross-sectional view showing an essential part of the loading spring of the fifth embodiment.
Figure 15B:
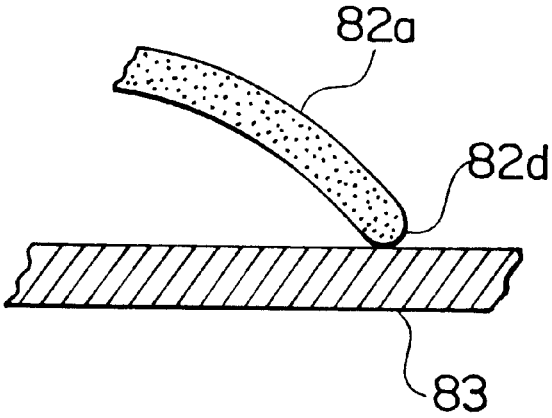
FIG. 15B is a cross-sectional view showing another part of the loading spring of FIG. 15A.

FIGS. 15A and 15B are illustrations of essential portions of the loading spring 82*a*, in which FIG. 15A shows a detailed cross section of the staking lock (stopper) at the upper portion of FIG. 13A.

The electrode opening operation is the same as that of the second embodiment.

In the case of the second embodiment, the portion connected with the movable conductive rod 4 contacts the stopper 71 in the electrode opening direction and stopped. Therefore, a stable opened electrode state is realized.

In FIG. 13B, however, the staking lock 85 connected with the washer 84 contacts the seat plate 83 and it is pressed by the seat plate 83 in the electrode opening direction and stopped. Therefore, a stable opened electrode state is realized.

In FIG. 14B, the washer 84 at the loading spring 82*a* side contacts the staking lock 85 connected with the seat plate 83 and it is pressed by the staking lock 85 in the electrode opening direction and stopped. Therefore, a stable opened electrode state is realized.

By providing the staking lock 85, the amount of use of the loading springs 82*a* and 82*b* is fixed to reduce the fatigue of the loading springs 82*a* and 82*b*, lengthening service life.

Moreover, by providing the staking lock 85, it is possible to omit the space needed by the stopper 71 of the second embodiment.

Furthermore, by forming a part or whole of the staking lock 85 with a cushioning material, the impact of electrode opening is absorbed by the staking lock 85 when the opened electrode state is realized by the electrode opening operation and thereby, is not transmitted to the rest of the switchgear, particularly to the switch 1. Therefore, the service life of the switch 1 is lengthened.

Sixth Embodiment

As the outside diameter of the loading springs 82*a* and 82*b* tends to increase, by using a material with a large elastic modulus such as steel, beryllium copper, titanium alloy, or fiber reinforced plastic as the material of the loading springs 82*a* and 82*b*, it is possible to decrease the outside diameter of the loading springs 82*a* and 82*b*.

Seventh Embodiment

FIGS. 15A and 15B show the contact portions between the loading spring 82*a*, the washer 84 serving as a spring support, and the seat plate 83, in which the cross sections of the ends of the loading spring 82*a* contacting the washer 84 and the seat plate 83 are provided with rounded edges 82*c* and 82*d*.

Thus, by decreasing the friction of the contact portions between the washer 84, seat plate 83, and loading spring 82*a*, the loading spring 82*a* smoothly expands or contracts in the radial direction at the time of the opening or closing operation. Therefore, it is possible to repeat the opening or closing operation many times without using a lubricating oil.

The conical spring 82*b* is also provided with the same rounded edges.

Figure 16A:
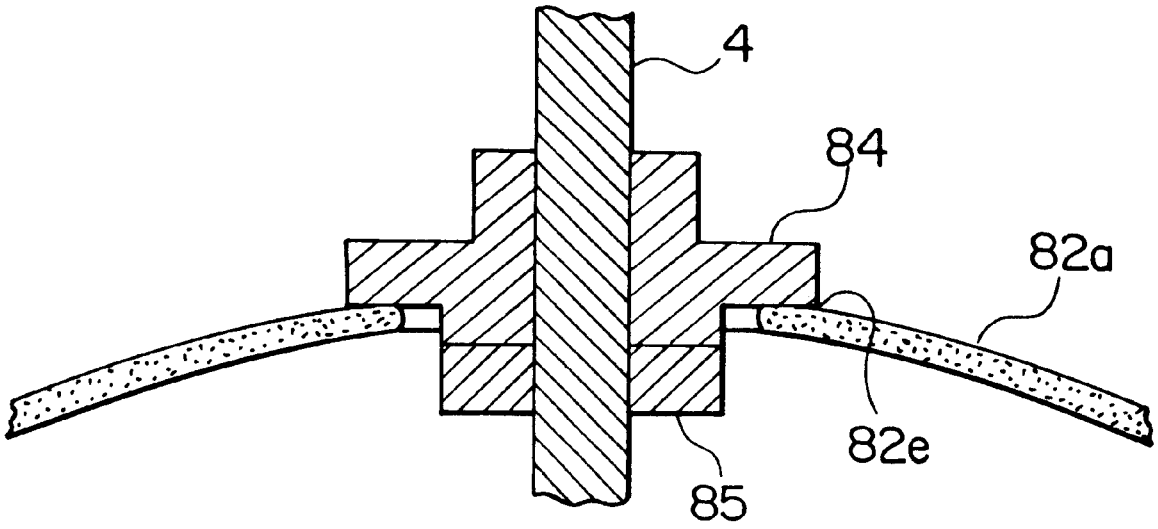
FIG. 16A is a cross-sectional view showing an essential part of a loading spring of a seventh embodiment of the present invention.
Figure 16B:
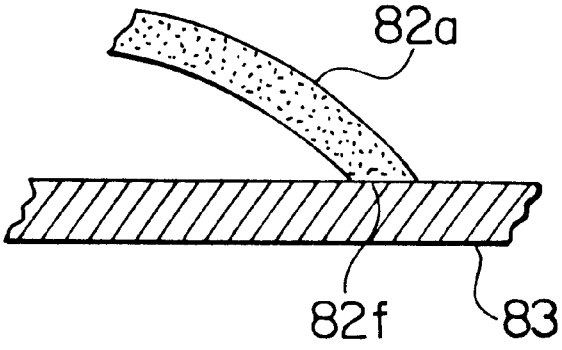
FIG. 16B is a cross-sectional view showing another part of the loading spring of FIG. 16A.

Moreover, as shown in FIGS. 16A and 16B, the contact areas of the portions of the conical spring 82*a* contacting the washer 84 and the seat plate 83 can be increased. Thus, by decreasing the spring load for the unit area, the loading spring 82*a* smoothly expands or contracts in the radial direction without being caught by the washer 84 or seat plate 83 at the time of the opening or closing operation and therefore, the opening or closing operation can be securely performed.

The contact areas of the conical spring 82*b* may also be increased.

Eighth Embodiment

In the case of this embodiment, surface treatment for decreasing friction is applied to the surfaces of the loading springs 82*a* and 82*b* or the washer 84 and seat plate 83.

The surface treatment uses coating with molybdenum dioxide, graphite, or fluorocarbon resin and as a commodity Defric Coat Coating is available.

By performing the above surface treatment, the friction of the contact portions between the washer 84 and seat plate 83 on the one hand and the loading springs 82*a* and 82*b* on the other is decreased and -the loading spring 82*a* smoothly expands or contracts at the time of the opening or closing operation. Therefore, it is possible to repeat the opening or closing operation many times without using a lubricating oil.

Moreover, the surface treatment may be applied not only to either the loading springs 82*a* and 82*b* or the washer 84 and seat plate 83 but also to both. Furthermore, the surface treatment may be applied only to those portions where they contact each other.

Ninth Embodiment

This embodiment uses a material harder than the loading springs 82*a* and 82*b* for the washer 84 and the seat plate 83.

Thus, the contact portions between the washer 84 and seat plate 83 on one hand and the loading springs 82*a* and 82*b* on the other do not wear down and the loading springs 82*a* and 82*b* smoothly expand or contract in the radial direction at the time of the opening or closing operation. Therefore, it is possible to repeat the opening or closing operation many times without using a lubricating oil.

Tenth Embodiment

This embodiment prevents non-contact of an electrode from occurring.

Figure 17B:
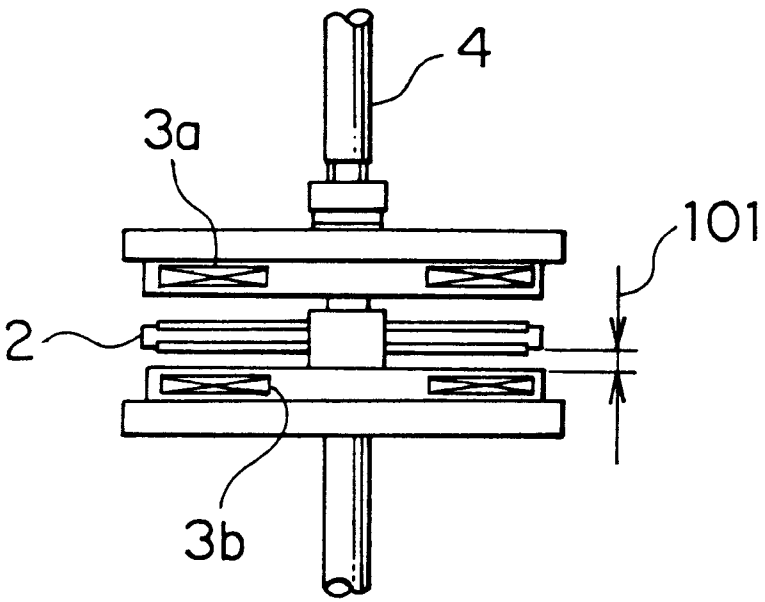
FIG. 17B is a side view showing the opened electrode state of FIG. 17A.
Figure 17A:
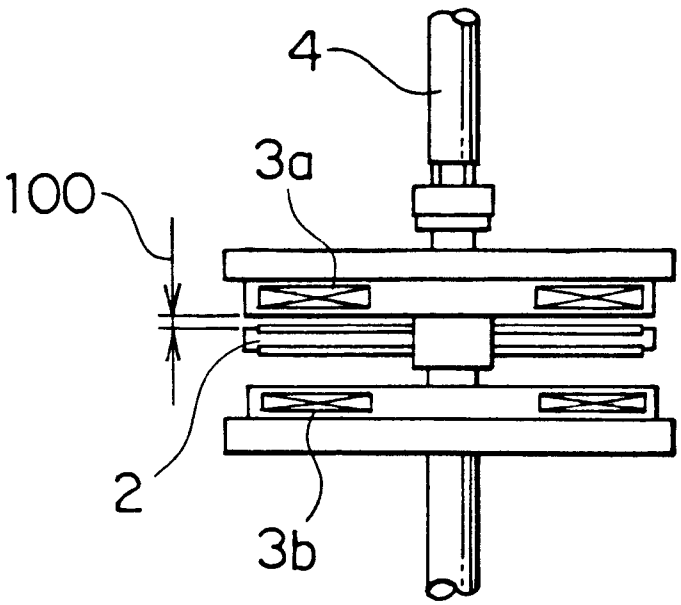
FIG. 17A is a side view showing a closed electrode state of a tripping and closing mechanism according to a tenth embodiment of the present invention.

FIG. 17A shows the positional relationships between the coils 3*a* and 3*b* on one hand and the repulsing section 2 on the other in the closed electrode state, in which symbol 100 denotes a distance between the coil 3*a* and the repulsing section 2 in the opened electrode state.

In the closed electrode state, the distance 100 between the coil 3*a* and the repulsing section 2 is made larger than the allowable abrasion length of the movable electrode 5 and the fixed electrode 6.

Thus, even if the movable electrode 5 and the fixed electrode 6 are abraded, it is possible to prevent the repulsing section 2 from being caught by the coil 3*a* and the non-contact of an electrode from occurring.

A structure in which a repulsing section is sandwiched between coils is shown in FIGS. 17A and 17B. However, the present invention can also be applied to the structure of the fourth embodiment in which a coil is sandwiched between repulsing sections as shown in FIGS. 11A and 11B.

Eleventh Embodiment

This embodiment decreases the impact imparted to an electrode by decreasing the closing speed and moreover, prevents chattering.

In FIG. 17B, symbol 101 denotes a distance between the coil 3*b* and the repulsing section 2 in the opened electrode state. The distance 101 is set so as to be longer than the distance 100 between the repulsing section 2 in the closed electrode state and the coil 3*a* used for the electrode opening operation shown in FIG. 17A.

By setting the distance 101 as described above, the repulsive force for closing is smaller than the repulsive force for electrode opening and the closing speed is smaller than the electrode opening speed. Therefore, it is possible to decrease the impact for closing, prevent an arc between the movable electrode 5 and the fixed electrode 6 due to chattering, and prevent welding.

FIGS. 17A and 17B show a structure in which a repulsing section is sandwiched between coils. However, the present invention can also be applied to the structure of the fourth embodiment in which a coil is sandwiched between repulsing sections as shown in FIGS. 11A and 11B.

When a closing coil and an electrode opening coil are different from each other in dimension, number of turns of coil, or current value, the difference between the distances 100 and 101 in FIG. 17 is not directly related to the difference between repulsions. In this case, a coil and a repulsing section are arranged by considering the difference between repulsions at the time of electrode closing and opening.

Twelfth Embodiment

This embodiment uses only one charging power supply for charging a charging capacitor to drive closing and electrode-opening coils and makes it possible to perform electrode opening immediately after closing or closing immediately after electrode opening.

Figure 18:
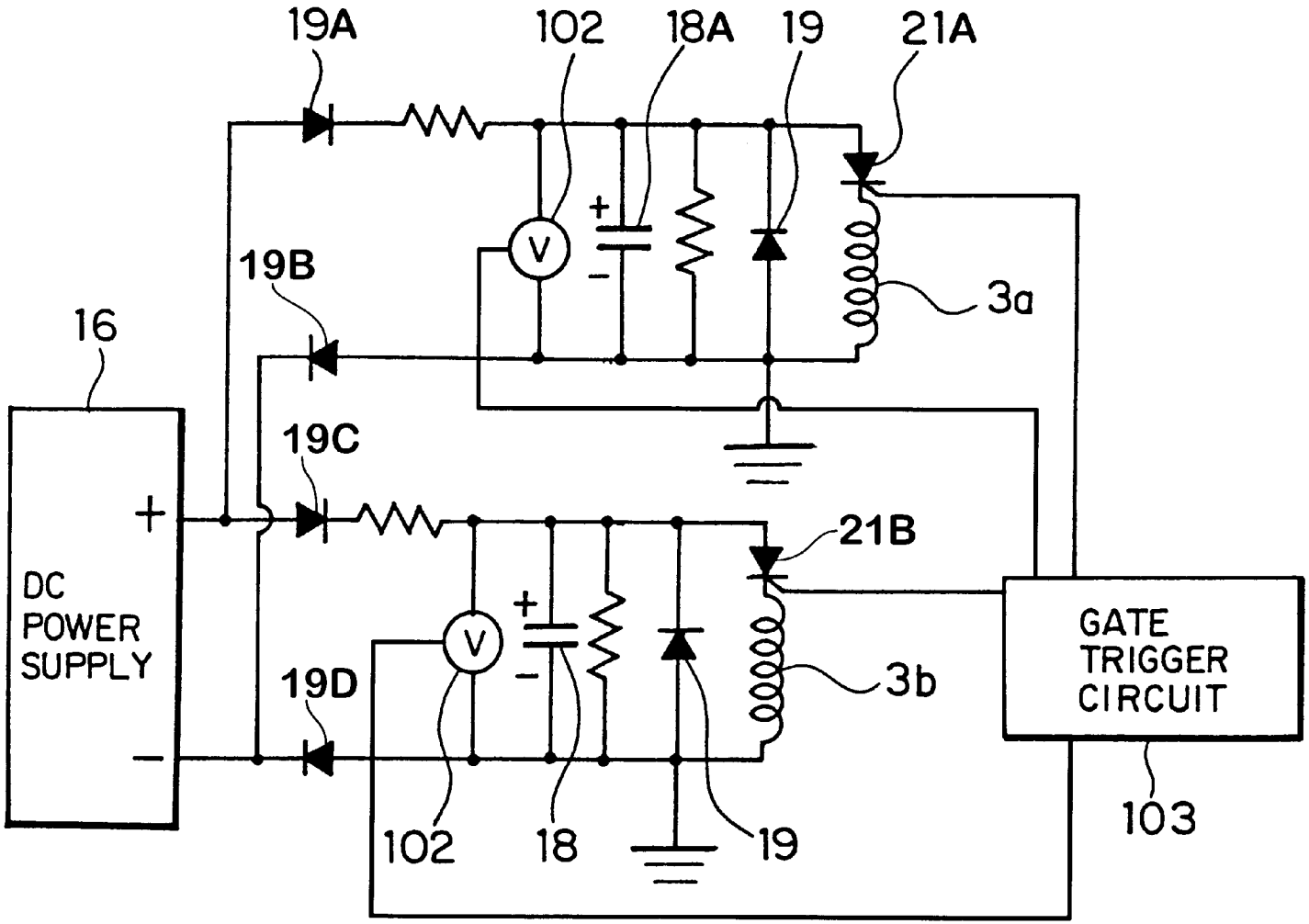
FIGS. 18 and 18A are circuit diagrams showing a power supply unit of a twelfth embodiment of the present invention.

FIG. 18 shows a structure of the power supply of this embodiment. In the figure, an electrode opening coil 3*a* and a closing coil 3*b* are provided between a DC power supply 16 for charging and a gate trigger circuit 103. Charging capacitors 18A and 18B, diodes (rectifying devices) 19A, 19B, 19C and 19D, thyristor switches 21 and voltmeters 102 are connected to the coils 3*a* and 3*b*.

Figure 18A:
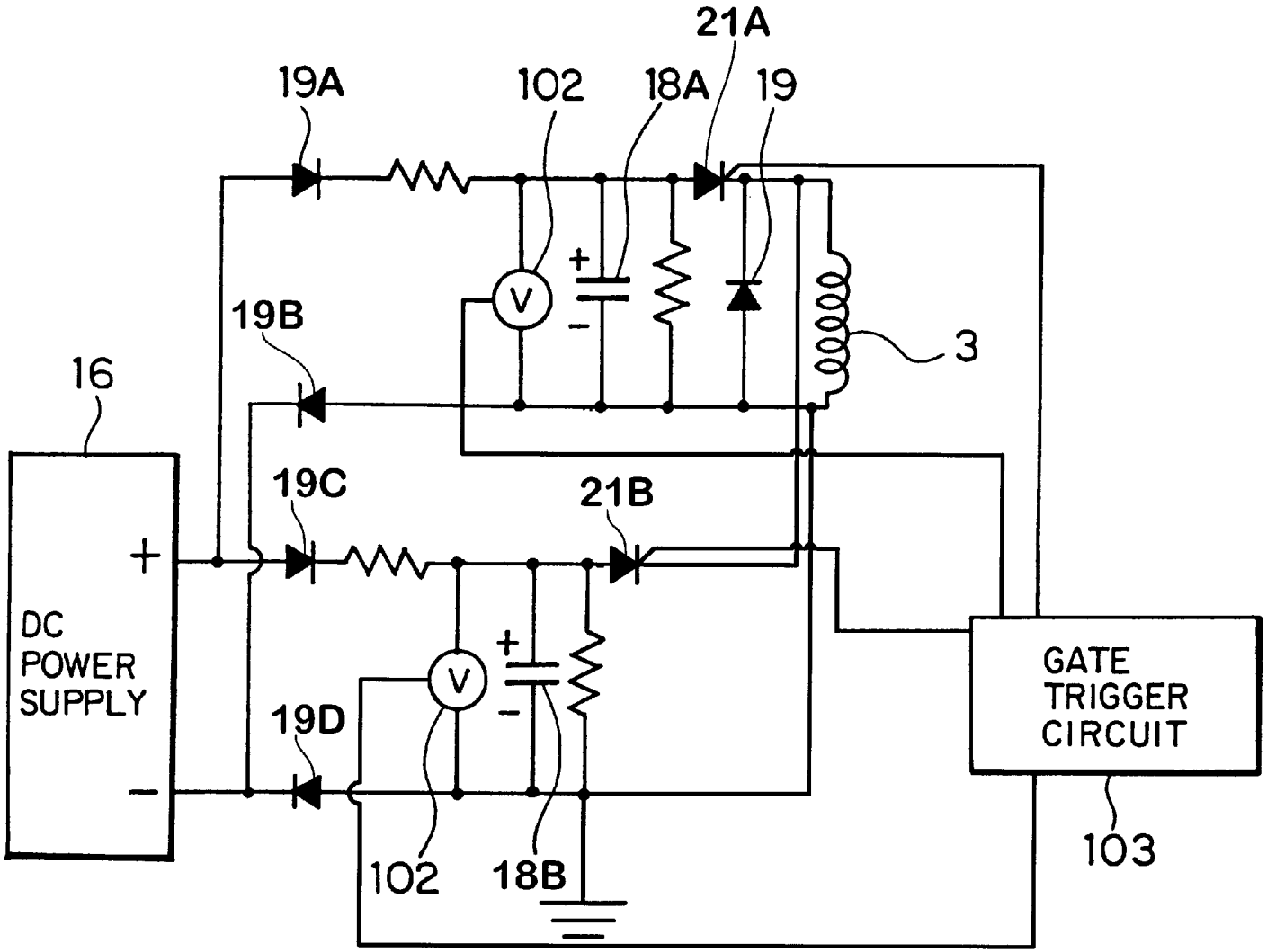

As shown in FIG. 18A and 18B, charging capacitors 18 are arranged in the electrode opening coil 3*a* and electrode closing coil 3*b* respectively and only one DC power supply 16 is provided for the two parallel charging capacitors 18A and 18B.

Moreover, the diodes 19A, 19B, 19C and 19D are arranged between the two parallel charging capacitors 18A and 18B and one DC power supply 16. The diodes 19A, 19B, 19C and 19D prevent current from circulating between the capacitors 18A and 18B.

By using the diode 19A and 19B, it is possible to prevent current from flowing from the charging capacitor 18A used for the electrode opening operation to the charging capacitor 18B used for the electrode closing operation and with just one charging DC power supply 16 the electrode opening operation can be realized immediately after the electrode closing operation. Moreover, the electrode closing operation can also be realized immediately after the electrode opening operation.

Furthermore, in FIG. 18, it is possible to prevent current from circulating between the capacitors by only two diodes 19A and 19C at the positive side by omitting the two diodes 19B and 19D at the negative side.

Furthermore, this embodiment can also be applied to the switchgear of the fourth embodiment in FIG. 11 comprising electrode-closing and electrode-opening repulsing sections and an electrode closing-and-opening coil. In particular, as shown in FIG. 18A, the electrode opening coil 3*a* and the electrode closing coil 3*b* of FIG. 18 are replaced by a single electrode closing-and-opening coil 3, and the thyristor switches 21A and 21B are connected to the electrode closing-and-opening coil 3 in order to control the supply of current to the electrode closing-and-opening coil 3 from the charging capacitors 18A and 18B.

Thirteenth Embodiment

This embodiment controls the opening and closing operations so that the gate trigger circuit 103 does not operate when the voltage of the charging capacitor 18A and 18B measured by the voltmeter 102 is lower than the voltage necessary for the opening and closing operations in FIG. 18.

If the closing or electrode-opening operation is performed before a capacitor is completely charged, the capacitor is discharged and it takes a long time to charge the capacitor until the next closing or electrode-opening operation can be performed. In this case, it is possible to improve the reliability by controlling the closing and electrode-opening operations to charge the capacitor and prevent the charging time from increasing.

Fourteenth Embodiment

This embodiment corresponds to a case of performing closing immediately after electrode opening and electrode reopening immediately after the closing.

Figure 19:
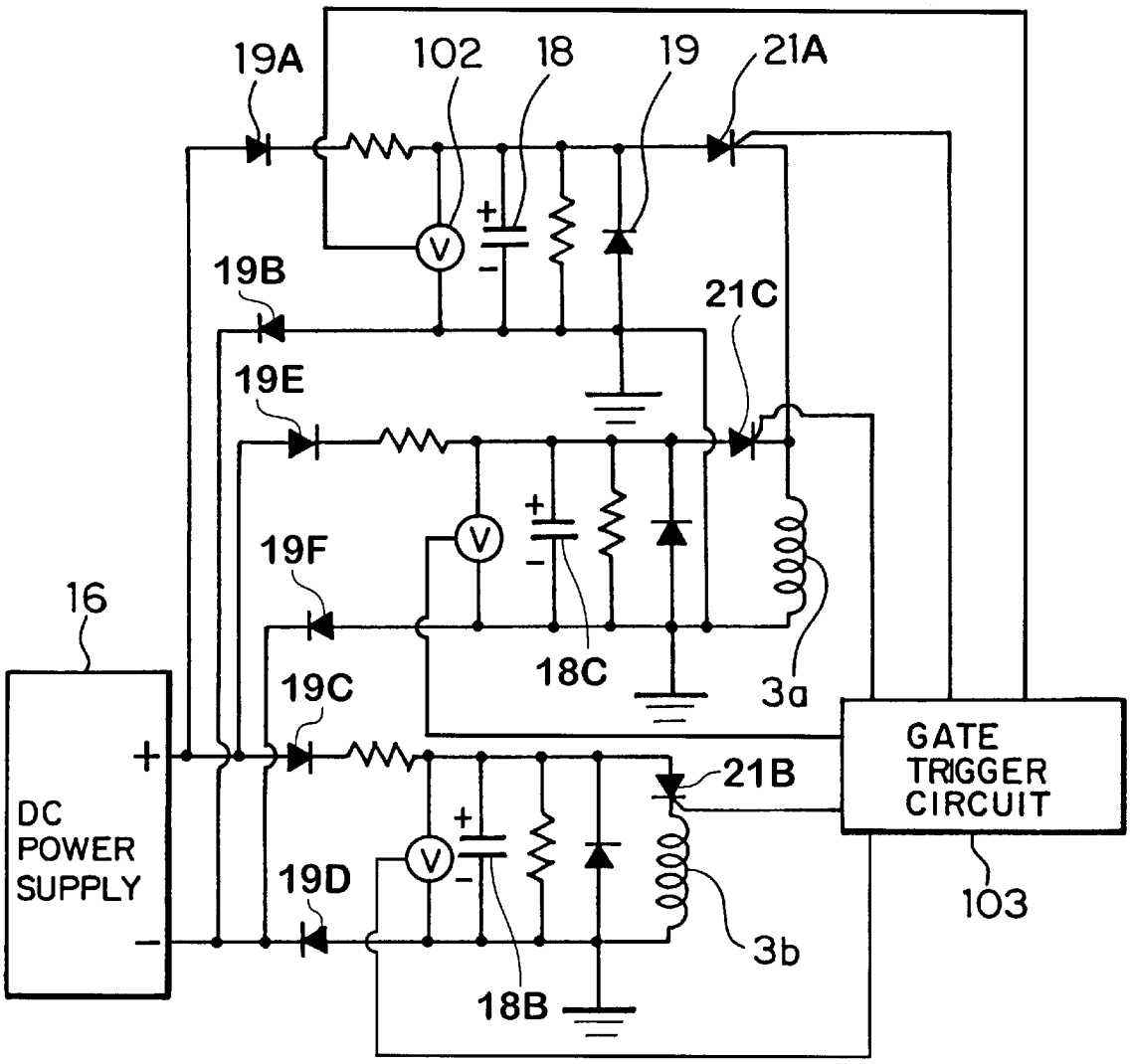
FIGS. 19 and 19A are circuit diagrams showing a power supply unit of a fourteenth embodiment of the present invention.

FIG. 19 shows a circuit diagram of this embodiment. Because symbols are the same as those in FIG. 18, their description is omitted here.

Two charging capacitors 18A and 18C are used for the electrode opening coil 3*a*, one charging capacitor 18B is used for the electrode closing coil 3*b*, and only one charging DC power supply 16 is used for the three parallel charging capacitors 18.

Moreover, the diode 19A, 19B, 19C, 19D, 19E and 19F is set between the three parallel charging capacitors 18 on one hand and one charging DC power supply 16 on the other. The diode 19 prevents current from circulating between the capacitors.

Thereby, it is possible to decrease the time of the electrode opening→electrode closing→electrode reopening cycle.

Moreover, in FIG. 19, it is possible to prevent current from circulating between the capacitors by omitting three diodes 19A, 19D and 19F at the negative side and using only three diodes 19A, 19C and 19E at the positive side.

Figure 19A:
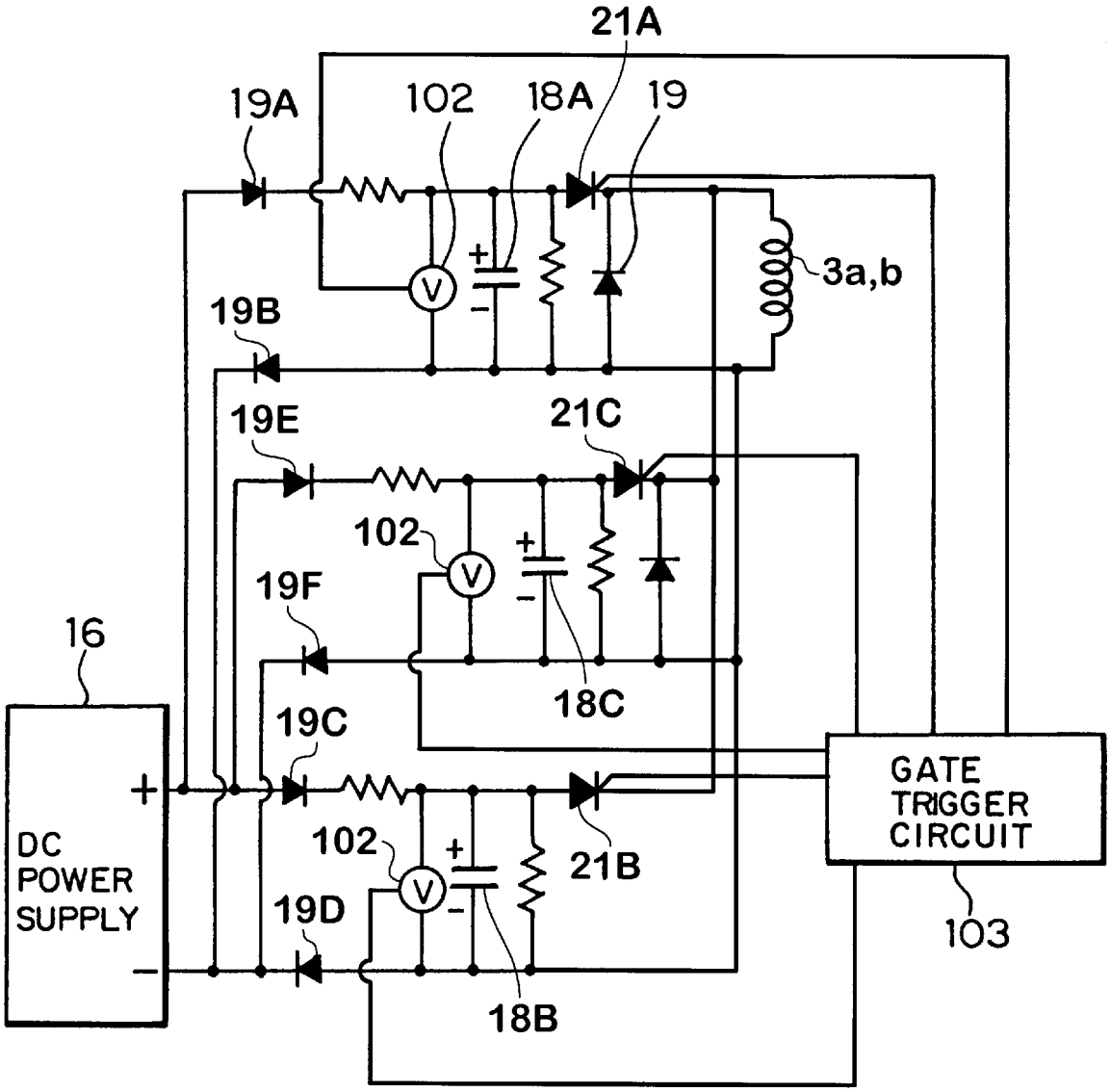

Furthermore, this embodiment can also be applied to the switchgear of the fourth embodiment in FIG. 11 comprising electrode-closing and electrode-opening repulsing sections and an electrode closing-and-opening coil. In particular, as shown in FIG. 19A, the electrode opening coil 3*a* and the electrode closing coil 3*b* of FIG. 19 are replaced by a single electrode closing-and-opening coil 3, and the thyristor switches 21A, 21B and 21C are connected to the electrode closing-and-opening coil 3 in order to control the supply of current to the electrode closing-and-opening coil 3 from the charging capacitors 18A, 18B and 18C.

Fifteenth Embodiment

This embodiment decreases a power supply in cost and size.

Figure 20:
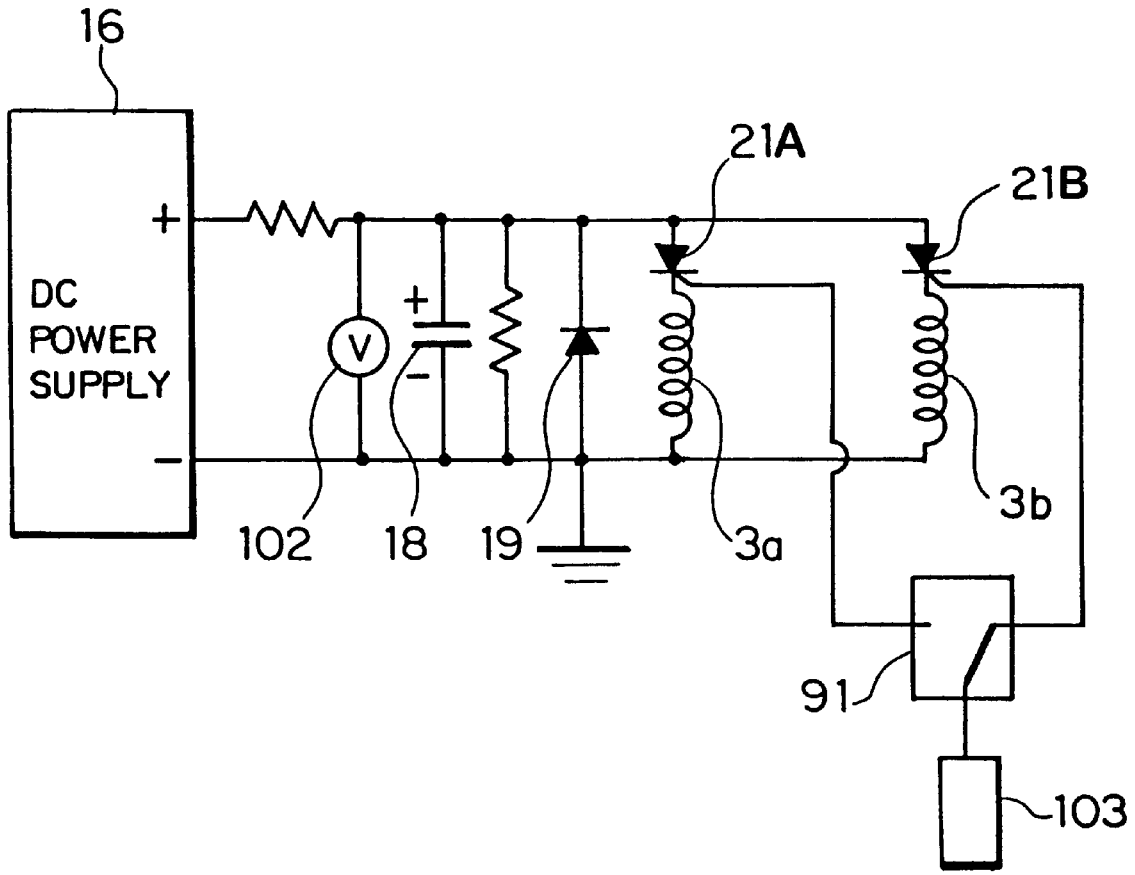
FIG. 20 is a circuit diagram of a power supply unit of a fifteenth embodiment of the present invention.

FIG. 20 is a circuit diagram of the power supply of this embodiment, in which symbols except the limit switch 91 are the same as those of the power supply in FIG. 18. Therefore, their description is omitted.

One charging capacitor 18 is used for the electrode opening coil 3*a* and the electrode closing coil 3*b* and the limit switch 91 is set between the electrode-opening and electrode-closing thyristor switches 21A and 21B on the one hand and the gate trigger circuit 103 on the other. This limit switch is set to the position of the limit switch 91 of the fifth embodiment shown in FIG. 12.

Because the limit switch 91 is changed to the electrode closing side or the electrode opening side whenever the electrode opening or closing operation is performed, it is possible to perform the electrode opening and closing operations even by one charging DC power supply 16 and one capacitor 18. Thereby, it is possible to decrease the power supply in cost and size.

Sixteenth Embodiment

This embodiment prevents the charging time of a capacitor from increasing due to an improper cutoff timing of the current supplied to a coil at the time of closing or electrode opening.

Figure 21:
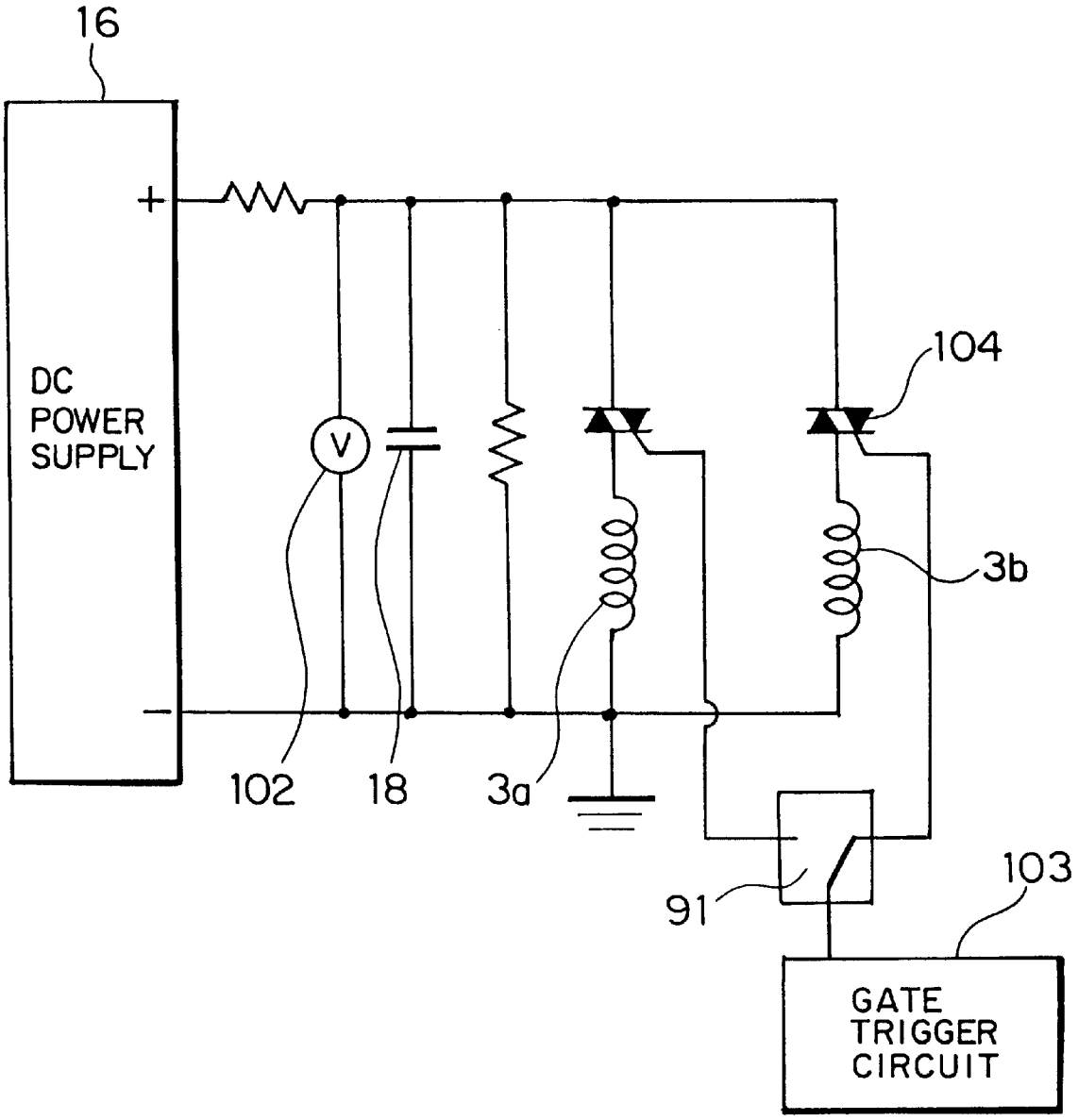
FIG. 21 is a circuit diagram of a power supply unit of a sixteenth embodiment of the present invention.

FIG. 21 is a circuit diagram of the power supply of this embodiment, in which symbols except a TRIAC 104 are the same as those of the power supply in FIG. 20. Therefore, their description is omitted.

The TRIAC 104 is constituted by connecting two thyristors in parallel so that current can flow in forward and backward directions.

Figure 22:
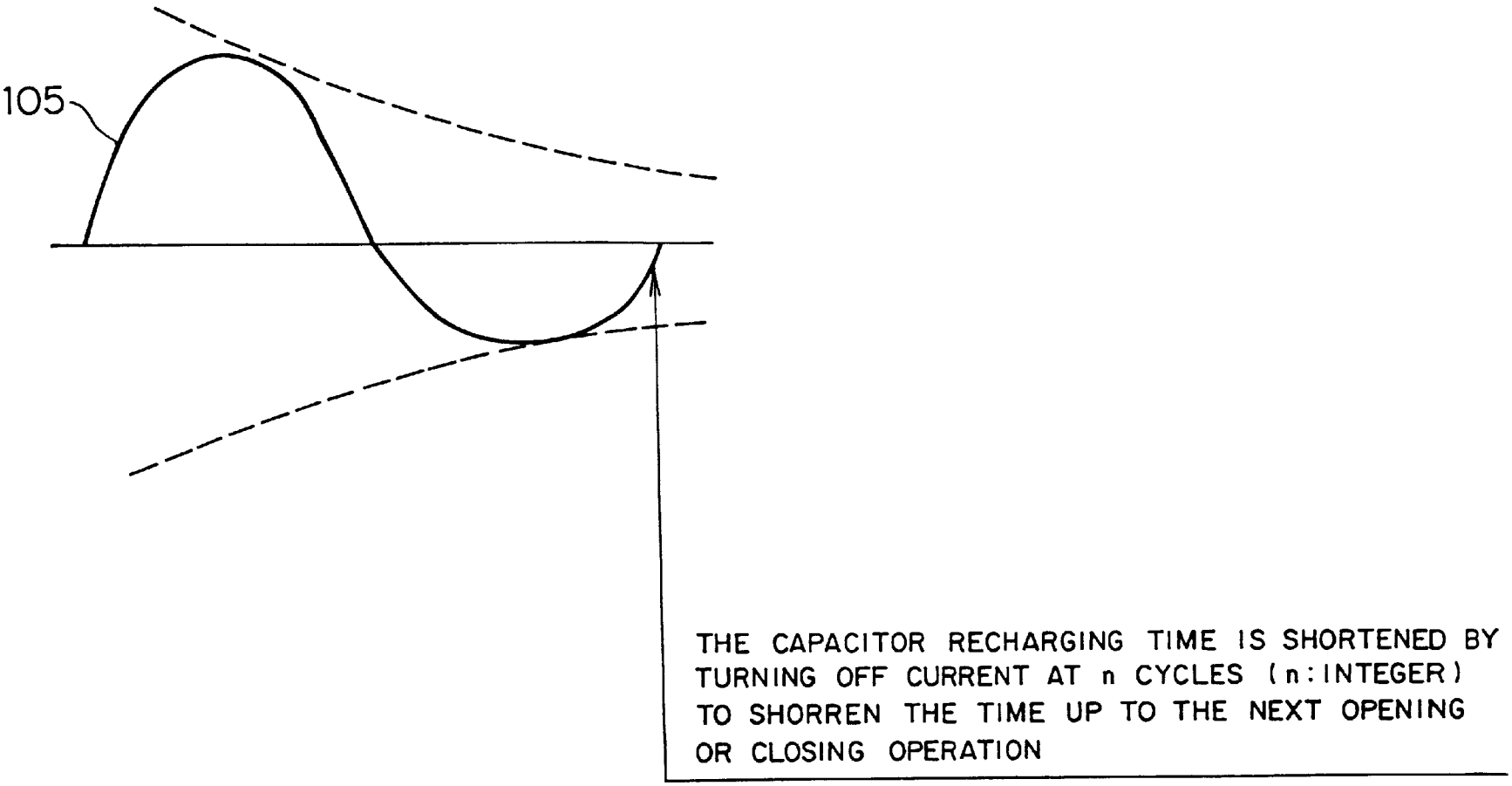
FIG. 22 is a diagram showing a waveform of a current flowing through a coil of the sixteenth embodiment.

Moreover, symbol 105 shown in FIG. 22 denotes a waveform of the current to be supplied to a coil.

One charging capacitor 18 is used for the electrode opening coil 3*a* and the electrode closing coil 3*b* and the limit switch 91 is set between the electrode-opening and electrode-closing TRIACs 104 on the one hand and the gate trigger circuit 103 on the other.

The current 105 to be supplied to a coil controls the TRIAC 104 so that it is cut off at the timing of one cycle or "n" cycles (n: positive integer). Thereby, when performing electrode opening after electrode closing, for example, the charging capacitor 18 is recharged in a half cycle of the negative side at the time of electrode closing. Therefore, the charging time is shortened and thus, the time between electrode closing and electrode opening can also be shortened.

Moreover, because remaining capacitors have a large charging energy, it is possible to perform electrode opening immediately after the electrode closing operation or electrode closing immediately after the electrode opening operation.

It is possible to select and use the power supplies of the twelfth and sixteenth embodiments according to necessity.

Seventeenth Embodiment

This embodiment improves the insulating characteristic of a switchgear and downsizes the switchgear.

Figure 23B:
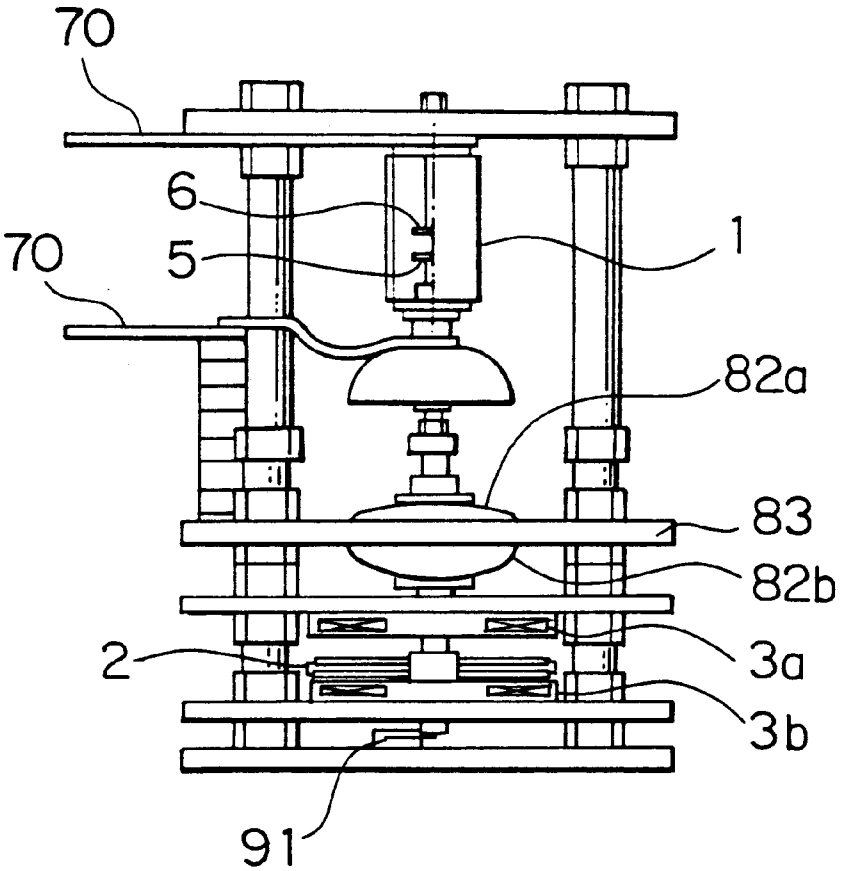
FIG. 23B is a side view showing an opened electrode state of FIG. 23A.
Figure 23A:
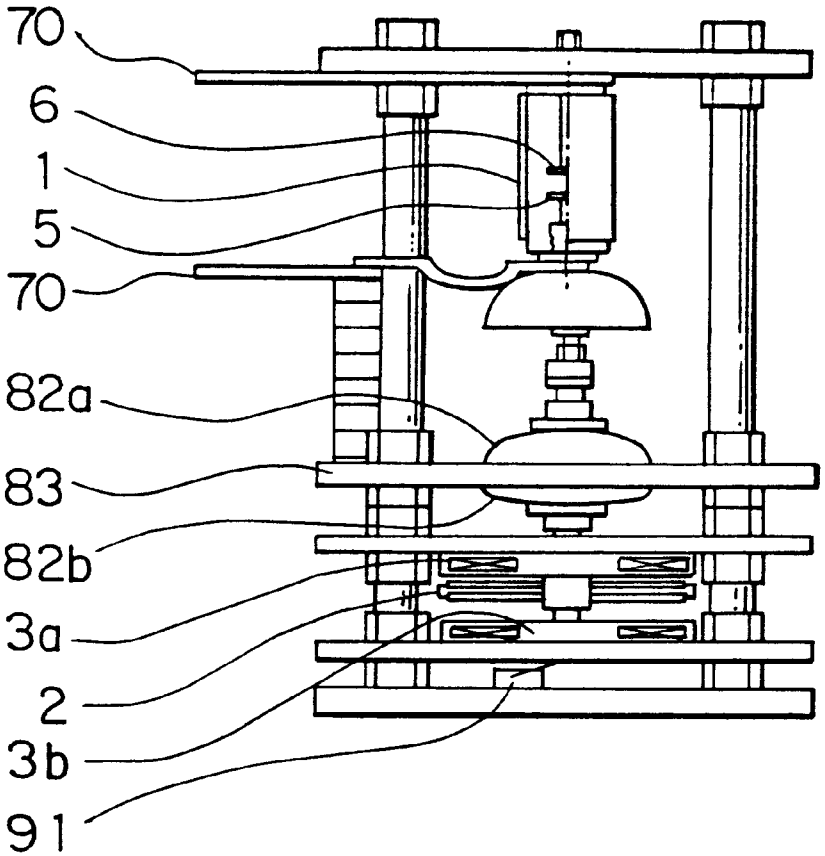
FIG. 23A is a side view showing a closed electrode state of a switchgear according to a seventeenth embodiment of the present invention.

FIG. 23A is a side view showing a closed electrode state of a switchgear according to a seventeenth embodiment of the present invention. FIG. 23B is a side view showing an opened electrode state of FIG. 23A.

A switchgear is downsized by arranging the switch 1, loading springs 82*a* and 82*b*, coil 3*a*, repulsing section 2, and coil 3*b* in order so that the switch 1 through which a large current flows and the coils 3*a* and 3*b* through which a control current flows are not adjacent to each other, improving the insulating characteristic.

Because the closing and electrode-opening operations of this embodiment are the same as those of the fifth embodiment, their description is omitted.

Eighteenth Embodiment

Figure 24B:
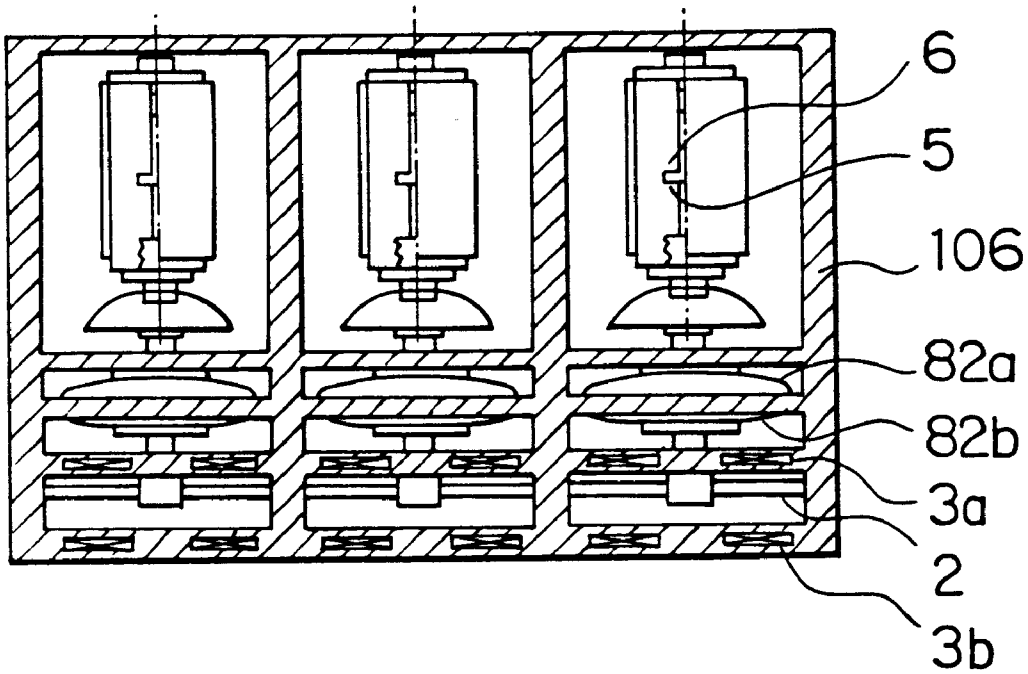
FIG. 24B is a front view of FIG. 24A.
Figure 24A:
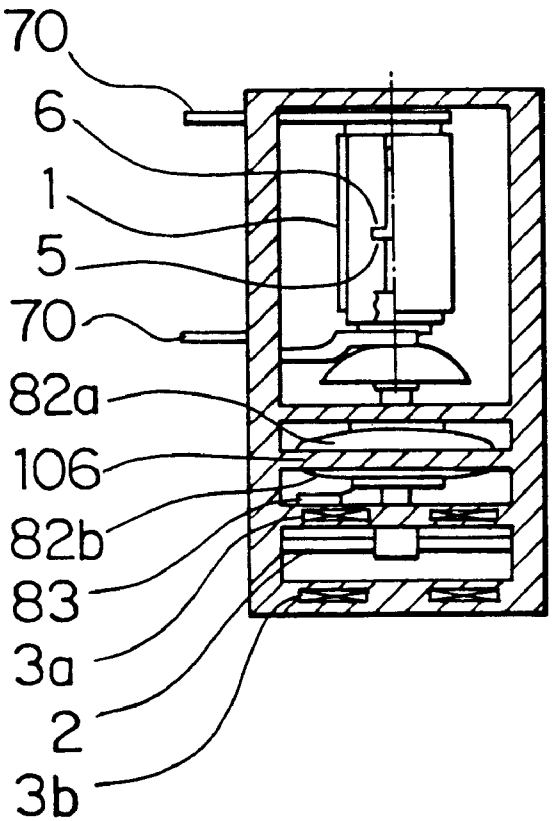
FIG. 24A is a side view showing a closed electrode state of a switchgear according to an eighteenth embodiment of the present invention.

FIG. 24A is a side view showing a closed electrode state of a switchgear according to an eighteenth embodiment of the present invention. FIG. 24B is a front view of FIG. 24A. In FIG. 24A, symbols except a molding 106 are the same as those of the seventeenth embodiment. Therefore, their description is omitted.

A three-phase switchgear is downsized by simultaneously arranging three switchgears in the molding 106.

Because the closing and electrode-opening operations of this embodiment are the same as those of the fifth embodiment, their description is omitted.

In the case of a switchgear of the present invention, the spring energy from the closed electrode state up to the opened electrode state is small and therefore, the electromagnetic repulsion energy of a coil is also reduced, the power supply of a coil can be decreased in size, and the impact at the time of electrode opening or closing is small. Therefore, it is possible to lengthen the service life of a switch.

Moreover, because it is possible to not use a latch mechanism, a switchgear with fast opening and closing operations can be obtained.

Moreover, because a loading spring uses a conical spring, the materials and shapes of the conical spring and a spring support are considered, and a stopper is used, it is possible to improve the operation of the conical spring and the reliability of the closing and electrode-opening operations.

Also, because a repulsing section and a coil are appropriately arranged, contact of an electrode is improved, the electrode closing speed is limited, and thereby welding of the electrode can be prevented.

Additionally, because a power supply is used in which a charging capacitor is provided for each coil, it is possible to perform electrode opening immediately after closing and closing immediately after electrode opening and moreover, respond to a case requiring electrode reopening.

Furthermore, because only one charging power supply and only one charging capacitor are used and coils are switched in accordance with the electrode-opening or closing operation, the power supply can be downsized and the cost can also be reduced.

Moreover, because a coil current is turned on/off by a bidirectional switching device and the current flowing through a coil is cut off at the timing of "n" cycles, the capacitor charging time after closing or electrode-opening is shortened and the next closing and electrode-opening can be performed at an early stage.

Furthermore, because the closing and electrode-opening operations are controlled in response to a voltage drop of a charging capacitor, it is possible to shorten the capacitor charging time and quickly respond to the next closing and electrode-opening operation.

Additionally, because the distance between an electrode on the one hand and a tripping mechanism and a closing mechanism on the other is increased, it is possible to improve the insulating characteristics.

Furthermore, because the whole system is molded, it is possible to downsize the system.

What is claimed is:

1. A switchgear comprising:

pair of electrodes and a tripping and closing mechanism for opening and closing said electrodes, wherein said tripping and closing mechanism comprises:

a movable electrode-closing repulsing section, a movable electrode-opening repulsing section, a stationary electrode closing-and-opening coil disposed between the electrode-closing repulsing section and the electrode-opening repulsing section for imparting a repulsive force to said electrode-closing and electrode-opening repulsing sections by generating eddy currents in said electrode-closing and electrode-opening repulsing sections, an electrode closing capacitor for supplying current to said electrode closing-and-opening coil when closing said electrodes, an electrode opening capacitor for supplying current to said electrode closing-and-opening coil when opening said electrodes, and a charging power supply for charging said electrode closing and opening capacitors.

2. A switchgear according to claim 1, wherein a rectifying device is set between said electrode closing capacitor and said electrode opening capacitor so that no current circulates between them.

3. A switchgear according to claim 1, further comprising means for controlling electrode-opening and closing operations based in a detected charging voltage for at least one of an electrode opening and closing operations so that when said detected voltage drops below a predetermined level, said means for controlling electrode-opening and closing operations preventing a triggering of said at least one of an electrode opening and closing operations.

4. A switchgear according to claim 1, further comprising a second electrode opening capacitor for supplying current to said electrode closing-and-opening coil when opening said electrodes.

5. A switchgear according to claim 1, further comprising an opened electrode state holding mechanism for holding said electrodes open, wherein said opened electrode state holding mechanism uses a loading spring mechanism which applies a load in a direction opposite to a direction in which said loading spring mechanism applies a load when said electrodes are closed.

6. A switchgear according to claim 1, further comprising a loading spring mechanism for loading said electrodes, wherein the ratio of force to displacement in said loading spring mechanism changes during closing and opening operations so that a load applied by said loading spring mechanism in an electrode closing direction decreases during at least a part of an operation of said switchgear from a state in which said electrodes are closed to a state in which said electrodes are opened.

7. A switchgear comprising a pair of electrodes and a tripping and closing mechanism for opening and closing said electrodes, wherein said tripping and closing mechanism comprises:

a movable repulsing section, a stationary electrode closing coil and a stationary electrode opening coil disposed on opposite sides of the stationary repulsing section for imparting a repulsive force to said repulsing section by generating an eddy current in said repulsing section, a capacitor for supplying current to said electrode closing coil and said electrode opening coil, a charging power supply for charging said capacitor, and electrode-closing-and-opening change means for selectively changing electrode-opening and closing operations so that current can be supplied from said capacitor to said electrode closing coil or said electrode opening coil.

8. A switchgear according to claim 7, further comprising means for controlling electrode-opening and closing operations based on a detected charging voltage for at least one of an electrode opening and closing operations so that when said detected voltage drops below a predetermined level, said means for controlling electrode-opening and closing operations preventing a triggering of said at least one of an electrode opening and closing operations.

9. A switchgear according to claim 7, further comprising an opened electrode state holding mechanism for holding said electrodes open, wherein said opened electrode state holding mechanism uses a loading spring mechanism which applies a load in a direction opposite to a direction in which said loading spring mechanism applies a load when said electrodes are closed.

10. A switchgear according to claim 7, further comprising a loading spring mechanism for loading said electrodes, wherein the ratio of force to displacement in said loading spring mechanism changes during closing and opening operations so that a load applied by said loading spring mechanism in an electrode closing direction decreases during at least a part of an operation of said switchgear from a state in which said electrodes are closed to a state in which said electrodes are opened.

11. A switchgear comprising:

a pair of electrodes and a tripping and closing mechanism for opening and closing said electrodes, wherein said tripping and closing mechanism comprises:

a movable repulsing section;

a stationary electrode closing coil and a stationary electrode opening coil for imparting a repulsive force to said repulsing section by generating an eddy current in said repulsing section, an electrode closing capacitor for supplying current to said electrode closing coil when closing said electrodes, an electrode opening capacitor for supplying current to said electrode opening coil when opening said electrodes, and a charging power supply for charging said electrode closing and opening capacitors.

12. A switchgear according to claim 11, further comprising a second electrode opening capacitor for supplying current to said electrode closing-and-opening coil when opening said electrodes.

13. A switchgear according to claim 11, further comprising an opened electrode state holding mechanism for holding said electrodes open, wherein said opened electrode state holding mechanism uses a loading spring mechanism which applies a load in a direction opposite to a direction in which said loading spring mechanism applies a load when said electrodes are closed.

14. A switchgear according to claim 11, further comprising a loading spring mechanism for loading said electrodes, wherein the ratio of force to displacement in said loading spring mechanism changes during closing and opening operations so that a load applied by said loading spring mechanism in an electrode closing direction decreases during at least a part of an operation of said switchgear from a state in which said electrodes are closed to a state in which said electrodes are opened.

* * * * *